US005998111A

United States Patent [19]

Abe

[11] Patent Number: 5,998,111

[45] Date of Patent: Dec. 7, 1999

[54] PROCESS FOR PRODUCING PHOTOGRAPHIC SUSPENDED PROCESSING AGENT COMPOSITION

[75] Inventor: Akira Abe, Kanagawa, Japan

[73] Assignee: Fuji Photo Film Co., Ltd., Minami Ashigara, Japan

[21] Appl. No.: 09/047,307

[22] Filed: Mar. 25, 1998

[30] Foreign Application Priority Data

Mar. 31, 1997 [JP] Japan ..... 9-081078

[51] Int. Cl.[6] ..... G03C 5/30

[52] U.S. Cl. ..... 430/458; 430/466

[58] Field of Search ..... 430/458, 466

[56] References Cited

U.S. PATENT DOCUMENTS

| | | | |
|---|---|---|---|
| 2,735,774 | 2/1956 | Henn | 430/453 |
| 2,784,086 | 3/1957 | Henn | 430/466 |
| 3,238,043 | 3/1966 | Levy | 430/458 |
| 5,891,608 | 4/1999 | Hashimoto et al. | 430/458 |
| 5,914,221 | 6/1999 | Kim et al. | 430/466 |

FOREIGN PATENT DOCUMENTS

| | | |
|---|---|---|
| 500485 | 3/1982 | Japan . |

*Primary Examiner*—Hoa Van Le

*Attorney, Agent, or Firm*—Burns, Doane, Swecker & Mathis, LLP

[57] ABSTRACT

A process for producing a photographic suspended processing agent composition is disclosed, comprising previously mixing at least two powder or granular solid components constituting said composition and rapidly adding said mixed powder or granular solids to water or a liquid medium mainly comprising water under quick stirring to disperse and suspend the solid components, thereby producing a suspended processing agent composition for silver halide photographic materials.

6 Claims, No Drawings

PROCESS FOR PRODUCING PHOTOGRAPHIC SUSPENDED PROCESSING AGENT COMPOSITION

FIELD OF THE INVENTION

The present invention relates to a process for producing a processing agent composition for use in processing silver halide photographic light-sensitive materials, more specifically, the present invention relates to a process for producing a concentrated development processing agent composition, which is compact to reduce the weight of waste container, the storage space and the transportation cost, can be easily dissolved even in chilled water to ensure excellent handleability, and has high storage stability.

BACKGROUND OF THE INVENTION

In general, the processing of silver halide photo-graphic light-sensitive materials, for example, the processing of a silver halide color photographic light-sensitive material, comprises fundamental processes of color development, desilvering and image stabilization including water washing. In the color development process, the color developing agent reacts with a silver salt to thereby imagewise produce a dye and developed silver. In the desilvering process, the developed silver produced in the color development process is oxidized (bleached) into a silver salt by a bleaching agent having oxidizing action and removed from the light-sensitive layer by a fixing agent which forms soluble silver together with unused silver halide, or the oxidation into a silver salt and the removal thereof are performed in one stage by a bleach-fixing solution. In the image stabilization process, the atmosphere of the image layer is adjusted to attain the stability of the image formed over a long period of time.

In the black-and-white development, the fundamental process also comprises development, desilvering and water washing.

In respective processing steps, an aqueous solution containing one or more processing chemicals (called a processing solution) is used. Each processing solution is relatively low in the concentration and accordingly, the system where a processing solution usable as it is, is produced by a manufacturer of processing chemicals, transported to a processing laboratory and stored, is generally inadequate in view of profitability, storage space or working.

In order to solve this problem, two methods have been conventionally used. One is a method of preparing a mixture of powder chemicals by mixing processing chemicals constituting the processing solution in a ratio according to the processing solution construction, packaging the mixture to form a so-called solid processing agent, supplying the solid processing agent to a processing laboratory, dissolving it in water at the processing laboratory to have an appropriate concentration, and using the dilution as the processing solution. Another is a method of dissolving the constituent processing chemicals in a high concentration, filling the solution in the liquid and concentrated state into a container to produce a concentrated liquid processing agent, supplying the processing agent to a processing laboratory, diluting it with water to have a predetermined concentration at the laboratory, and using the dilution as a processing solution. The former is specifically described in U.S. Pat. No. 2,843,484. With respect to the latter case, U.S. Pat. No. 3,574,619 describes a concentrated liquid processing agent for color development and U.S. Pat. No. 3,467,521 describes a black-and-white concentrated processing agent.

In recent years, to cope with the requirements for improvement of the productivity in the development processing and for rapid processing, the concentration of the development processing solution rather tends to have a higher concentration. When constituent processing chemicals are contained at a concentration in-excess of the solubility, insoluble components are separated in the solution to present a suspended state. In general, the suspended particle cannot actually have a size of 50 $\mu$m or less even if the stirring efficiency is extremely increased. On the contrary, with the passing of time, the particles grow bulky due to the coagulation mechanism or partly the Ostwald ripening mechanism, as a result, they sooner or later become incapable to be floating in the solution and start to precipitate. The precipitate is gradually solidified to lose flowability as the time elapses and turns into a bulky lump or adheres to the wall or bottom of the container, and then the processing solution is no more usable. Accordingly, the liquid and concentrated processing agent must fundamentally be a homogeneous solution having a concentration less than the saturation solubility so that it can be stably stored and used without no problem. Under these circumstances, reduction of volume by concentrating a solution is very hard to attain.

With respect to the liquid concentrated processing agent, pasting of a black-and-white development processing solution has been conventionally known, for example, in U.S. Pat. No. 2,735,774. Further, in the case of a color developer, pasting or concentrating has also been applied for various purposes. U.S. Pat. No. 2,784,086 discloses pasting using an alginic acid derivative as a tackifying agent, namely, a thickener. Japanese Published Unexamined International Application No. 57-500485 discloses a technique of pasting a concentrated liquid processing agent for color development. According to this technique, a processing agent is maintained in the concentrated paste state by adding silicon dioxide, sodium sulfate, lithium sulfate or diatomaceous earth which are photographically inactive. This is, however, accompanied by the increase in the ionic strength and not preferred for the concentrating. The addition of these pasting aids causes useless reduction of the solubility and at the same time, lowers the activity coefficient of the processing solution constituent chemicals.

Furthermore, the pasting is not to elevate the degree of concentration by increasing the solubility of processing chemicals but only delays the separation or if the separation starts, retards the cohesive solidification of insoluble matters to somewhat prolong the use term, and the volume reduction is not substantially solved. On the contrary, since the processing agent is reduced in the flowability, the workability at the processing laboratory is very impaired. In particular, the liquid processing agent loses the advantage such that the dissolving work can be dispensed with.

Accordingly, it was considered that if a processing agent having both the small volume as an advantage of the solid processing agent and the flowability as an advantage of the liquid processing agent is obtained, the above-described problems can be solved and moreover, a liquid development processing agent for silver halide color photographic light-sensitive materials satisfying the requirements in various aspects such as profitability, environmental safety, workability and storage stability can be obtained, which is advantageous in that reduction in the volume of the processing agent, in the weight of the processing agent container, in the space for preservation and storage and in the cost for transportation of the processing agent can be realized, the chemicals can be rapidly and simply dissolved even in chilled water without any splashing or contact on the dissolving working for the preparation of the processing agent, and generation of tar due to air oxidation does not occur during the storage.

The cue for realizing the processing agent having both the small volume as an advantage of the solid processing agent and the flowability as an advantage of the liquid processing agent is a processing agent technique capable of ensuring the aging stability even in the concentrated state and stably performing the production with good reproducibility.

As a result of extensive investigations, the present inventor has found that a concentrated processing agent composition having the advantages both of the liquid processing agent composition and the solid processing composition as described above, namely, capable of maintaining the flowability even in the suspended state, can be realized. However, if the highly concentrated processing agent composition is produced by the usual method where the raw material chemicals are added in sequence to the mixing tank, insoluble suspended particles readily undergo changes by various conditions in the production process, for example, precipitate by coagulation, become bulky or solidify. Therefore, the reproducibility in the production is poor and stable production on a practical level is difficult to attain.

SUMMARY OF THE INVENTION

An object of the present invention is to establish a stable production process of a processing agent composition for silver halide photographic light-sensitive materials, the processing agent composition being highly concentrated and having flowability and aging stability.

As a result of further extensive investigations, the present inventor has found that the above-described problems can be overcome by (1) using a turbulent flow condition having a Reynolds' Number of 16 or more and (2) preparing a mixed powder of sparingly soluble solid components in advance of the addition to a mixing tank. More specifically, the object of the present invention has been attained by:

1. a process for producing a photographic suspended processing agent composition, comprising previously mixing at least two powder or granular solid components constituting the composition and rapidly adding the mixed powder or granular solids to water or a liquid medium mainly comprising water under quick stirring to disperse and suspend the solid components, thereby producing a suspended processing agent composition for a silver halide photographic material;
2. the process for producing a photographic suspended processing agent composition as described in item 1 above, wherein a part or whole of the liquid components out of the constituent components of a concentrated processing agent composition are dissolved into water and a mixture of powder or granular solid constituent components is rapidly added to the aqueous solution;
3. the process for producing a photographic suspended processing agent composition as described in item 1 or 2, wherein the composition comprises a coagulation inhibitor as a constituent component;
4. The process for producing a photographic suspended processing agent composition as described in item 3, wherein the coagulation inhibitor is a water-soluble polymer;
5. The process for producing a photographic suspended processing agent composition as described in item 3, wherein the coagulation inhibitor is a surface active agent selected from the group consisting of the compounds represented by formulae (SI) and (SII):

$$RO(CH_2CH_2O)_m[CH_2CH(OH)CH_2O]_nX \quad \text{(SI)}$$

wherein R represents an alkyl group having from 8 to 25 carbon atoms or a group represented by the formula:

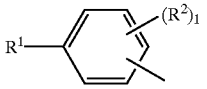

wherein $R^1$ represents an alkyl group having from 6 to 20 carbon atoms, $R_2$ represents a hydrogen atom or an alkyl group having from 1 to 20 carbon atoms, and 1 represents 0 or an integer of from 1 to 4, m represents an integer of from 40 to 200 when n is 0, an integer of from 10 to 100 when n is from 5 to 9, and 0 or an integer of from 1 to 100 when n is 10 or greater, n represents 0 or an integer of from 5 to 50, and X represents a hydrogen atom or $SO_3M$, wherein M represents a hydrogen atom or an alkali metal, $$R^3CON\underset{R^4}{(CH)}\underset{R^5}{(CH)}\underset{R^6}{(CH)}_pCOOM^2 \quad \text{(SII)}$$

wherein $R^3$ represents an alkyl group, $R^4$ represents a hydrogen atom or an alkyl group, $R^5$ and $R^6$ each independently represents a hydrogen atom, a hydroxyl group, an alkyl group or $CO_2M^1$, $M^1$ and $M^2$ each represents a hydrogen atom or an alkali metal, and p represents 0 or 1; and 6. The process for producing a photographic suspended processing agent composition as described in item 3, wherein the coagulation inhibitor is a hydrophilic organic compound selected from (1) monohydric and polyhydric alkanols and (2) lower alkylsulfonic acids and arylsulfonic acids.

DETAILED DESCRIPTION OF THE INVENTION

The embodiment for practicing the present invention is described in detail below.

The present invention is a production process for obtaining a suspended concentrated liquid processing agent composition having flowability and being stable. The term "suspended processing agent composition" as used herein means a processing agent composition in such a state that a part of processing agent constituent chemicals are insoluble and dispersed in a liquid as fine particles. The case where a part of fine particles are precipitated, is also included.

Usually, in a system where suspended particles are dispersed, bulking or precipitation is irregularly generated due to the coagulation or Ostwald ripening of particles to impair the reproducibility. This defect is particularly outstanding in the case of particles having a low solubility. Accordingly, a suspended processing agent composition which is stable for a long period of time cannot be obtained. However, when particles poor in the solubility, giving rise to the suspension, are previously well mixed to form a powder mixture and then rapidly added to and mixed with water or an aqueous solution having previously poured thereinto liquid constituent components, the coagulation or bulking is difficult to occur and stabilization of the process can be achieved. This effect is obtainable for the constituent components of which concentration in the composition exceeds a half (½) of the saturation concentration in water. The above-described operation is not necessary for the components having a large solubility and even if it is applied, the effect is relatively small.

Representative examples of the constituent component having a concentration in excess of a half (½) of the saturation concentration include p-phenylenediamine-type color developing agents, azole-base antifoggants such as mercaptobenzotriazole, 6-nitroindazole and 5-methylbenzimidazole, and EDTA, 1,3-PDTA and iron(III) complex salts thereof, and in the case of an X-ray photographic processing agent composition, developing agents such as 1-phenyl-3-pyrazolidone and a derivative thereof, and hydroquinone. At the present time where the concentrating of the processing agent composition is aggressively driven, an extremely large number of constituent components are added in such an amount close to the limit of solubility.

With respect to the powder component, all powder components may be mixed and charged batchwise as a one-part agent. Or, at least solid components having low solubility (as described above, those having a formulation amount in excess of a half (½) of the saturation concentration in water) only may be mixed and charged batchwise. The powder mixture is preferably added rapidly as much as possible (within a short time) and it is advantageous to charge the mixture wholly at once quickly. The reason why the rapid addition is advantageous is not yet clearly known, however, it is assumed because the convection time in the microregion of a liquid phase medium where fine particles dissolve and deposit onto other particles, namely, a liquid phase composition region of causing growing and bulking of insoluble particles due to the Ostwald ripening, is reduced. The addition time is preferably as short as possible and in general, substantially the whole amount of solid components is preferably charged within 2 minutes, more preferably within 1 minute, still more preferably within 30 seconds.

The powdered mixture is necessary to be added in such a state that the aqueous medium in the mixing tank is being stirred by the turbulent flow having a Reynolds' number of 16 or more. The reason why the stirring is necessary is also assumed, similarly to the above, because the termination within a short time of the transient state where the bulking due to Ostwald ripening is readily caused, contributes to the stabilization of the suspended particles. The degree of stirring is required to satisfy the minimum requirement that the turbulent flow has a Reynolds' number of 16 or more, and the stirring is preferably performed by the turbulent flow having a Reynolds' number of 100 or more and 6,000 or less, more preferably 500 or more and 4,000 or less, still more preferably 1,000 or more and 4,000 or less.

The mixing tank used for this purpose is selected from the mixing tanks having any general purpose stirring means, for example, a vertical-type cylindrical stirring tank having a paddle, turbine or propeller rotary stirring blade, and a mixing tank in which the mixing is performed in the piped duct part, such as static mixer, tube injector or loop reactor.

In the case of a vertical-type cylindrical stirring tank having a paddle, turbine or propeller rotary stirring blade, the conditions are satisfied if the turbulent state is such that the Reynolds' number obtained by the formula:

$$Re=nd^2/\nu$$

wherein d is a diameter, n is a revolution number and v is a coefficient of kinematic viscosity is 16 or more.

In the case of a mixing tank in which the mixing is performed in the piped duct part, such as static mixer, tube injector or loop reactor, the Reynolds' number Re is obtained in approximation to:

$$Re=sd/\nu$$

wherein s is a drift velocity at the piped duct part for concentrated solutions under mixing and d is a duct diameter. It suffices if the Reynolds' number Re obtained by this formula satisfies the above-described conditions. In the case of a mixing tank having other system, the Reynolds' number can be approximately determined in accordance with the above-described theory. Briefly, the minimum requirement for the degree of stirring is that the Reynolds' number of the turbulent state obtained as above is 16 or more. The degree of stirring is preferably higher and the Reynolds' number is preferably 100 or more and 6,000 or less, more preferably 500 or more and 4,000 or less, still more preferably 1,000 or more and 4,000 or less.

In adding the mixed powder, the temperature of the suspended dispersion solution is adjusted between 15 and 35° C. and preferably controlled so that the temperature fluctuates within the width of 5° C.

Many constituent components cause a phenomenon accompanied by heat generation or subsidence continuously or simultaneously during the preparation process of the composition, such as hydration, dissolution, mixing, coagulation or crystallization. Accordingly, when the constituent components are individually added to the aqueous solution during the preparation, due to the intricies of the endothermic and exothermic phenomena, the temperature fluctuates complicatedly and greatly and the load of the control increases. The process of the present invention is advantageous in that the endothermic and exothermic factors cancel each other or are dispersed and the controlling load is small, but still the temperature and the fluctuation of temperature are preferably controlled to fall within the above-described range. By this control, the fluctuation of capabilities caused in every production is advantageously reduced and as a greater effect, the processing agent composition produced under the adjustment and control of the temperature can be stably stored for a long period of time with little generation of insoluble colored floating matters during the storage. The reason therefor is not known but is assumed because in the temporary super-saturation state to the utmost at the mixing of respective concentrated solutions, even a slight fluctuation of temperature greatly affects the generation of microscopic nuclei which cause the generation of an insoluble colored product.

The temperature can be controlled by using a general purpose apparatus such as an apparatus combining a temperature sensor and an electrothermic circuit switch or a steam switching valve. The temperature in the mixing tank, the container part at the time of direct injection and filling into the container, the mixing device part at the mixing on the eve, the jacket part in the periphery thereof or if desired, the duct part for respective concentrated solutions, must be kept at a predetermined temperature by using such an apparatus. The temperature controlling capability is preferably larger as a matter of course, however, on taking account of the profitability of the apparatus, the temperature controlling capability is as a standard such that the temperature fluctuation is ±5° C. within 1 minute after the addition of mixed powder components and ±1° C. within 5 minutes, preferably within 2 minutes, more preferably within 1 minute. In this range, good results can be obtained.

In the present invention, the processing agent composition is filled into a container to form a processing agent advantageous for the transportation, storage and use. In particular, when the processing agent composition is a developer or a development replenisher, the filling is preferably followed by displacement of air in the mouth part space at the upper portion of the container (hereinafter the space is referred to as a "head space") with inert gas and closing of the container with a cap to seal it. By this operation, the processing agent composition can be improved in the storage stability and stored for a long period of time. The slight oxygen remaining in the head space is considered to adversely affect the composition during the long-term storage.

The inter gas for use in the displacement of air may be any if it is inert and in view of easy availability and cost, nitrogen gas is most preferred, and argon gas is next preferred.

The degree of displacement is suitably 80% or more, preferably 90% or more, more preferably 95% or more, and the higher degree is more preferred.

The displacing method may be any as long as the displacement can be performed without fail, however, in view of practicability, a method of introducing an inert gas, for example, nitrogen gas into the inside of a container, filling the inside of the container with the nitrogen gas to effect thorough displacement, injecting concentrated solutions or a mixed solution thereof while continuously introducing the nitrogen gas, and immediately after the filling, tightly closing the container, is preferred. The displacement may be performed more perfectly if the filling device as a whole is placed in an atmosphere of inert gas, however, the completeness of such a level is not necessarily required in the conditions of the present invention.

The suspended processing agent composition of the present invention may contain, if desired, a coagulation inhibitor so as to further increase the stability within a range such that the apparent kinematic viscosity does not exceed 25 $cm^2$/sec, though the coagulation inhibition is not an essential constituent component in view of the photographic properties.

The "apparent" kinematic viscosity as used herein is a physical value obtainable in the case where even when the suspended processing agent contains precipitable components, coagulation is not caused and the flowability is kept, and means a kinematic viscosity determined in such a state that the precipitable components and suspended insoluble components are contained to serve as an average composition of the entire processing agent. The "apparent" kinematic viscosity of 25 $cm^2$/sec or less is a kinematic viscosity expressing the degree such that in supplying a suspended processing agent composition from a processing agent container to a development replenishing tank or the like as described later, the processing agent flows from the container at a practical rate and the residue adhering to the wall of the container can be washed out by a simple spray water washing.

In other words, a suspended processing agent composition having an apparatus kinematic viscosity of 25 $cm^2$/sec or less means that the composition has flowability despite the presence of insoluble suspended components or precipitable components and can be handled substantially in the same manner as a homogenous solution in taking out the processing agent from a processing agent container. Accordingly, a specific coating development device or processing solution ejection or injection device which are necessary in the case of a viscous development processing agent such as a pasted developer, is not required. It is known that these advantageous conditions can be realized when the liquid has a kinematic viscosity of 25 $cm^2$/sec or less.

In the following, the "kinematic viscosity" is an "apparent kinematic viscosity".

In producing the suspended processing agent composition of the present invention, a coagulation inhibitor may be added to further increase the stability, within the range such that the kinematic viscosity does not exceed 25 $cm^2$/sec. Preferred examples of the coagulation inhibitor include the following compounds. Since these compounds differ in the working mechanism and can be used alone or in combination to increase the effect, these compounds are described individually.

(1) a water-soluble polymer, (2) a surface active agent represented by formula (SI) or (SII), (3) a hydrophilic organic compound selected from mono- and polyhydric alcohols, lower alkylsulfonic acids and arylsulfonic acids, and (4) a compound which is one of essential components having a function necessary for exerting the photographic properties of the concentrated processing agent and has an action of increasing dispersibility of suspended particles.

The water-soluble polymer (1) is described. The water-soluble polymer imparts viscosity to prevent coagulation and solidification and is hereinafter referred to as a thickening agent. This coagulation inhibitor has two aspects of action advantageous and disadvantageous to the present invention. The advantageous action is, as described above, to delay the generation and separation of suspended particles and to retard the coagulation and bulking of particles separated, which gives an effect of increasing the aging stability of the processing agent composition and prolong the use life. The latter is to inhibit the flowability of the composition to thereby impair the handling suitability and washability, as a result, the effect of the present invention cannot be attained. Accordingly, if the composition has a room for the kinematic viscosity even after the concentrating, the concentrated liquid processing agent composition of the present invention can have an increased value by adding thereto a thickening agent in an amount within the range of not impairing the flowability. Conventionally known water-soluble polymers having a thickening property for use in the photographic processing solution may be used, however, a water-soluble polymer which is particularly effective is selected from cellulose derivatives, polyvinyl alcohol-base resins, polyvinyl pyrrolidone resins, poly(meth)acrylic acid-base resins, polystyrenesulfonic acid-base resins and modified products thereof.

Specific examples of the polymer include cellulose esters such as carboxymethyl cellulose, alkali metal salts thereof, hydroxymethyl cellulose and methyl cellulose, polyvinyl alcohol, polyvinyl pyrrolidone, polyacrylic acid and alkali metal salts thereof, polymethacrylic acid and alkali metal salts thereof, acrylic acid-methyl acrylate copolymers, methacrylic acid-methyl acrylate copolymers, acrylic acid·ethyl acrylate copolymers, polystyrenesulfonic acid and alkali metal salts thereof, copolymers of the above-described (meth)acrylic acid-base polymer and styrenesulfonic acid-base polymer, and modified resins thereof.

Particularly preferred examples of the polymer include carboxymethyl cellulose having an etherification degree of 1.3 (CMC1350 produced by Daicel KK) and carboxymethyl cellulose having an etherification degree of 1.37 (CMC1380 produced by Daicel KK), however, the present invention is by no means limited thereto.

The polymerization degree is preferably on the order of from 500 to 3,500, more preferably from 1,000 to 2,500, and the weight average molecular weight is from 20,000 to 1,000,000, preferably from 40,000 to 500,000.

The amount of the polymer added is from 0.1 to 10 wt %, preferably from 0.2 to 5 wt %, of the processing agent composition. When the viscosity of such a degree is imparted, stable suspension can be achieved without reducing the solubility of the constituent components of the composition and in the case where insoluble fine particles are separated, the precipitation and coagulation thereof are prevented.

The water-soluble polymer is added in an amount within the range of not impairing the flowability of the composition, in terms of the kinematic viscosity, of from 0.01 to 25 $cm^2$/sec, preferably from 0.05 to 23 $cm^2$/sec, more preferably from 0.1 to 20 $cm^2$/sec.

The kinematic viscosity of the composition can be determined by the calculation from the density and the coefficient of viscosity of the composition. The coefficient of viscosity (namely, viscosity) may be obtained using a viscometer having a proper measuring range selected from a rotational viscometer, a falling ball viscometer, an Ostwald viscometer and any general purpose viscometer having the same principle as any one of these three kinds of viscometers.

The surface active agent represented by formula (SI) or (SII) as compound (2) above can attain, when added, the same effect as the water-soluble polymer.

In formula (SI), the alkyl group represented by R may be linear or branched and may have a substituent, and the number of carbon atoms including the substituents is from 8 to 25, preferably from 9 to 18, more preferably from 10 to 16.

In the formula:

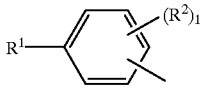

represented by R, $R^1$ is a linear or branched alkyl group having from 6 to 20, preferably from 8 to 16, more preferably from 9 to 12 carbon atoms, $R^2$ is a linear or branched alkyl group having from 1 to 20 carbon atoms, preferably a methyl group, an ethyl group, an n-propyl group, an i-propyl group, an n-butyl group, an i-butyl group, a t-butyl group, a pentyl group, an n-octyl group, a t-octyl group, an n-nonyl group or a t-nonyl group, 1 is 0 or an integer of from 1 to 4, preferably 1 is 0, and when 1 is an integer of from 1 to 4, the preferred combination of $R^1$ and $R^2$ is such that $R^1$ is an alkyl group having from 8 to 16 carbon atoms and $R^2$ is a methyl group, an ethyl group or a butyl group, or $R^1$ and $R^2$ both are an octyl group or a pentyl group. The formula represented by R links to the compound represented by formula (SI) at any position on the benzene ring thereof, preferably at para-position to the position of $R^1$. When n is 0, m represents an integer of from 40 to 200, preferably from 50 to 150, more preferably from 80 to 130, when n is an integer of from 5 to 9, m represents an integer of from 10 to 100, preferably from 20 to 80, more preferably from 30 to 70, and when n is an integer of 10 or greater, m represents 0 or an integer of from 1 to 100, preferably from 5 to 50, more preferably from 10 to 40.

n represents 0 or an integer of from 5 to 50, preferably 0 or an integer of from 5 to 30, more preferably 0 or an integer of from 10 to 20.

X represents a hydrogen atom or $SO_3M$ (wherein M is a hydrogen atom or an alkali metal, preferably sodium or potassium), preferably a hydrogen atom.

Compounds SI-1 to SI-52 as specific examples of the compound represented by formula (SI) are set forth below, however, the surface active agent for use in the present invention is by no means limited thereto.

SI-1

$(n)C_8H_{17}—O—(CH_2CH_2O)_{40}—H$

SI-2

$(n)C_8H_{17}—O—(CH_2CH_2O)_{50}—H$

SI-3

$(t)C_8H_{17}—O—(CH_2CH_2O)_{80}—H$

SI-4

$(t)C_8H_{17}—O—(CH_2CH_2O)_{130}—H$

SI-5

$C_{12}H_{25}—O—(CH_2CH_2O)_{40}—H$

SI-6

$C_{12}H_{25}—O—(CH_2CH_2O)_{50}—H$

SI-7

$C_{12}H_{25}—O—(CH_2CH_2O)_{80}—H$

SI-8

$C_{12}H_{25}—O—(CH_2CH_2O)_{130}—H$

SI-9

$C_{12}H_{25}—O—(CH_2CH_2O)_{150}—H$

SI-10

$C_{12}H_{25}—O—(CH_2CH_2O)_{200}—H$

SI-11

$C_{14}H_{29}—O—(CH_2CH_2O)_{50}—H$

-continued
SI-12
$C_{14}H_{29}$—O—$(CH_2CH_2O)_{80}$—H
SI-13
$C_{14}H_{29}$—O—$(CH_2CH_2O)_{130}$—H
SI-14
$C_{16}H_{33}$—O—$(CH_2CH_2O)_{50}$—H
SI-15
$C_{16}H_{33}$—O—$(CH_2CH_2O)_{80}$—H
SI-16
$C_{16}H_{33}$—O—$(CH_2CH_2O)_{130}$—H
SI-17
$C_{16}H_{33}$—O—$(CH_2CH_2O)_{150}$—H
SI-18
$C_{18}H_{35}$—O—$(CH_2CH_2O)_{50}$—H
SI-19
$C_{18}H_{35}$—O—$(CH_2CH_2O)_{100}$—H
SI-20
$C_{18}H_{35}$—O—$(CH_2CH_2O)_{150}$—H
SI-21
$C_{20}H_{39}$—O—$(CH_2CH_2O)_{100}$—H
SI-22
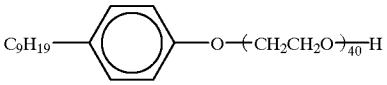
SI-23
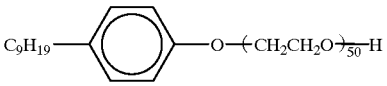
SI-24
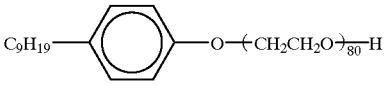
SI-25
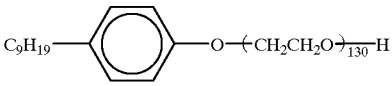
SI-26
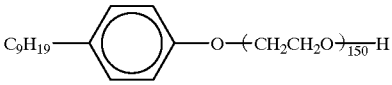
SI-27
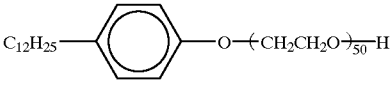
SI-28
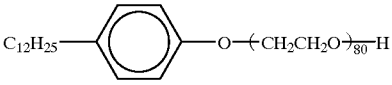
SI-29
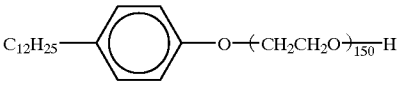
SI-30
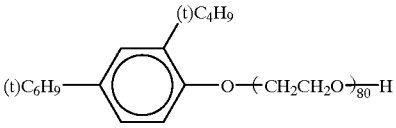

-continued
SI-31
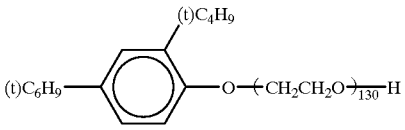
SI-32
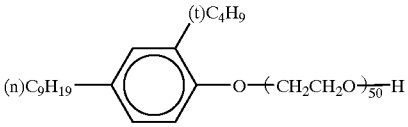
SI-33
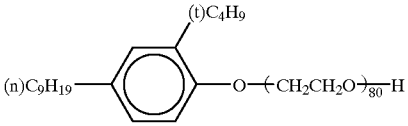
SI-34
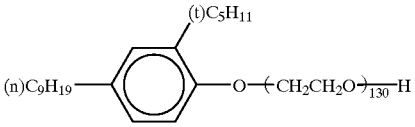
SI-35
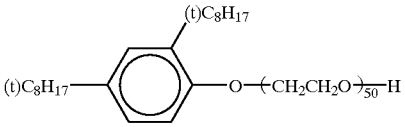
SI-36
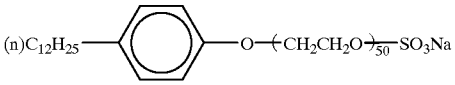
SI-37
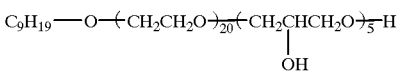
SI-38
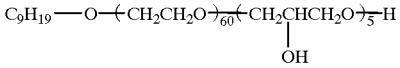
SI-39
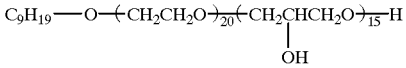
SI-40
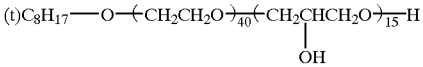
SI-41
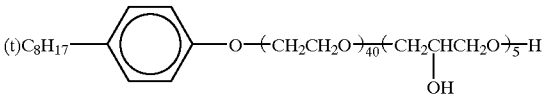
SI-42
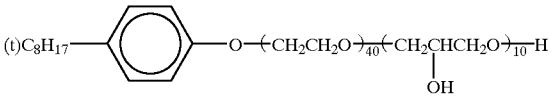
SI-43
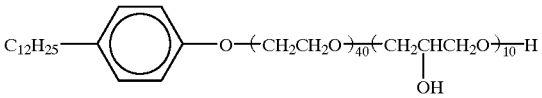

-continued

SI-44

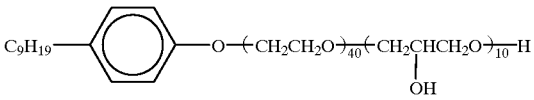

SI-45

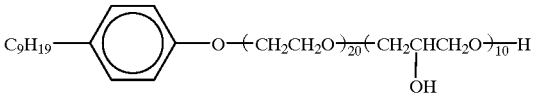

SI-46

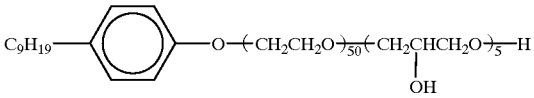

SI-47

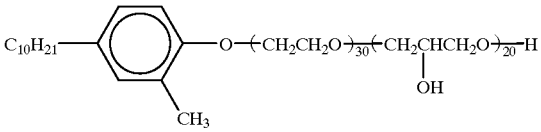

SI-48

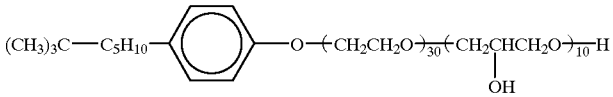

SI-49

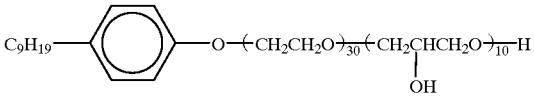

SI-50

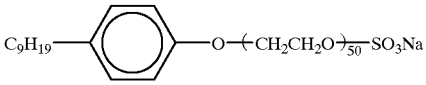

SI-51

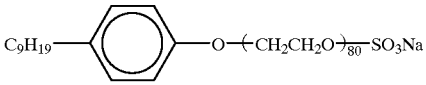

SI-52

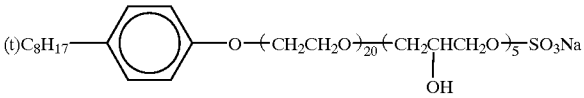

In formula (SII), $R^3$ represents an alkyl group which may be linear or branched and may have a substituent, and the number of carbon atoms including the substituents is from 6 to 20, preferably from 8 to 16, more preferably from 9 to 12. When $R^3$ has a substituent, $R^3$ having a substituent is preferably a carboxyalkyl group, a sulfoalkyl group, a dicarboxyalkyl group or a sulfocarboxyalkyl group, more preferably a carboxymethyl group, a sulfocarboxymethyl group, a carboxyethyl group or a sulfocarboxyethyl group. $R^4$ represents a hydrogen atom or an alkyl group having from 1 to 20, preferably from 1 to 3 or from 12 to 20 carbon atoms. $R^5$ and $R^6$ each independently represents a hydrogen atom, a hydroxyl group, a carboxyalkyl group or $CO_2M^1$, and has a number of carbon atoms of from 0 to 20, preferably from 0 to 5, more preferably from 0 to 3. $R^5$ and $R^6$ each is preferably a lower carboxyalkyl group such as a carboxymethyl group and a carboxyethyl group. $M^1$ and $M^2$ each represents a hydrogen atom or an alkali metal. p represents 0 or 1.

Compounds SII-1 to SII-56 as specific examples of the compound represented by formula (SII) are set forth below, however, the surface active agent for use in the present invention is by no means limited thereto.

SII-1

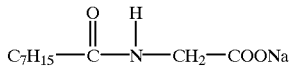

SII-2

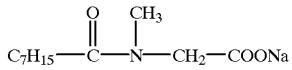

SII-3

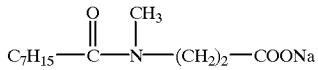

SII-4

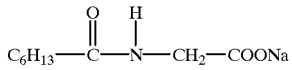

-continued
SII-5
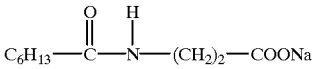
SII-6
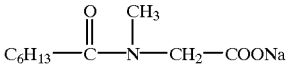
SII-7
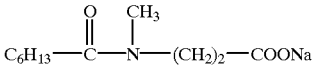
SII-8
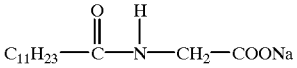
SII-9
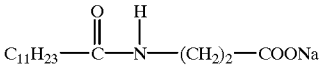
SII-10
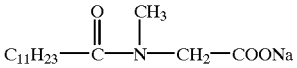
SII-11
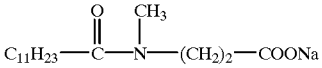
SII-12
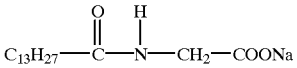
SII-13
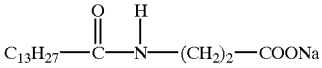
SII-14
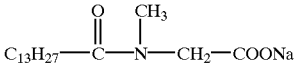
SII-15
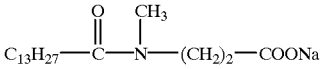
SII-16
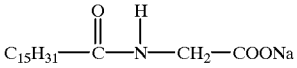
SII-17
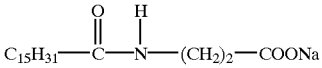
SII-18
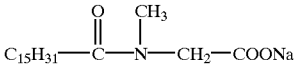
SII-19
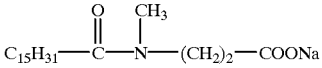
SII-20
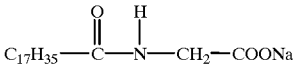
SII-21
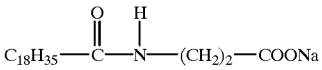
-continued
SII-22
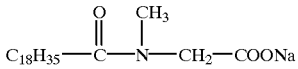
SII-23
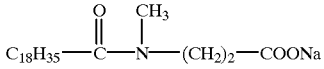
SII-24
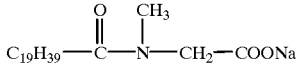
SII-25
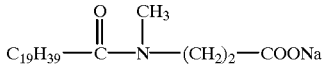
SII-26
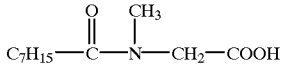
SII-27
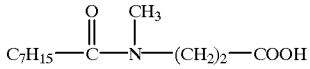
SII-28
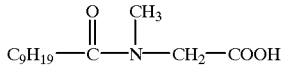
SII-29
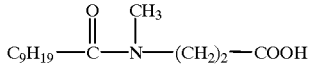
SII-30
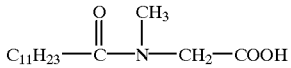
SII-31
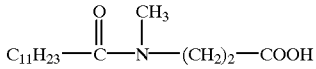
SII-32
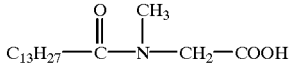
SII-33
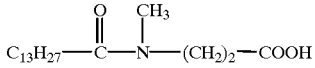
SII-34
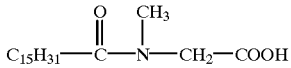
SII-35
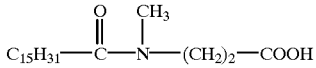
SII-36
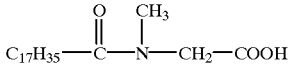
SII-37
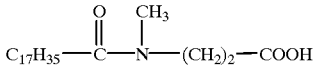
SII-38
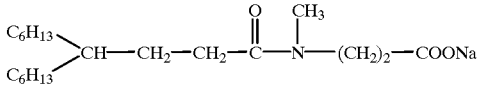

-continued

SII-39

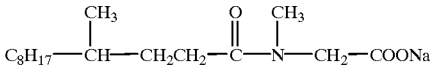

SII-40

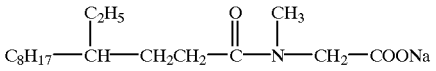

SII-41

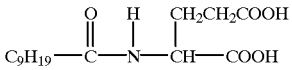

SII-42

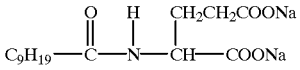

SII-43

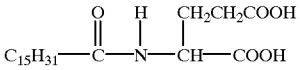

SII-44

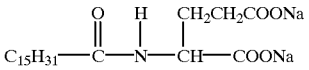

SII-45

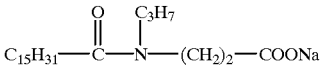

SII-46

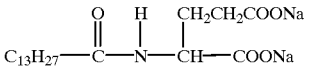

SII-47

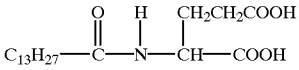

SII-48

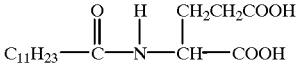

SII-49

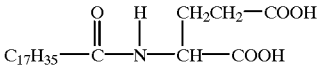

SII-50

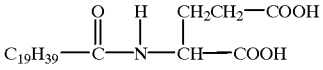

SII-51

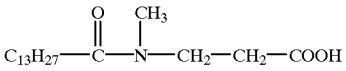

SII-52

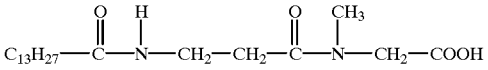

SII-53

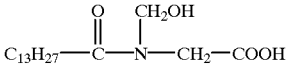

SII-54

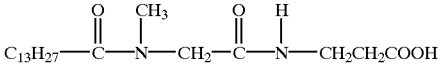

-continued

SII-55

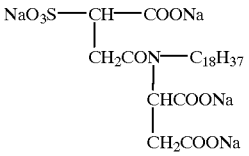

SII-56

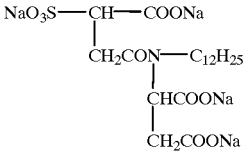

The amount of the surface active agent represented by formula (SI) or (SII) added is from 0.1 to 25 g, preferably from 0.5 to 15 g, more preferably from 1.0 to 10 g, per l of the suspended processing agent composition. When the surface active agents represented by formulae (SI) and (SII) are used in combination with each other, the effect can be more increased. In this case, the amounts of the surface active agents each is from 0.05 to 15 g, preferably from 0.2 to 10 g, more preferably from 0.5 to 5 g, per l of the processing agent composition, and the total amount thereof is from 0.1 to 25 g, preferably from 0.5 to 15 g, more preferably from 1.0 to 10 g, per l of the composition.

The hydrophilic organic compound selected from monohydric and polyhydric alcohols, lower alkylsulfonic acids and arylsulfonic acids, as category (3) of the coagulation inhibitor, is described below.

With respect to the monohydric and polyhydric alcohols, suitable examples of the monohydric alcohol include lower alcohols such as ethanol, propanol and ethoxyethanol, and suitable examples of the polyhydric alcohol include glycols such as ethylene glycol, propylene glycol, hexylene glycol, diethylene glycol, triethylene glycol and polyethylene glycol having a polymerization degree of from 2 to 200, triols such as 1,2,3-propanetriol(glycerin), polyhydroxy alcohols such as glycidol polymer, and benzyl alcohols.

The amount of the alcohols added depends on the objective compound intended to stably disperse, however, it is from 0.5 to 50 g, preferably from 0.5 to 25 g, more preferably from 2.0 to 10 g, per l of the suspended processing agent composition. The alkanols may be used in combination of two or more thereof.

In the production of the composition, an alkanol which is liquid at room temperature may be added either before or after the mixed powder agent is charged into water but usually, it is preferably added before the charging.

Examples of the lower alkyl- and arylsulfonic acids include p-toluenesulfonic acid, xylenesulfonic acid, benzenesulfonic acid, ethylenedisulfonic acid and hexylenedisulfonic acid. The amount of each acid added is from 0.1 to 20 g, preferably from 0.2 to 10 g, more preferably from 0.5 to 5 g, per l of the suspended processing agent composition. The lower alkyl- and arylsulfonic acids are particularly effective to the organic compound having a low solubility such as a developing agent in the composition for use in the development. In particular, p-toluenesulfonic acid is effective.

The compound which is one of the essential constituent components having a function necessary for exerting the photographic property of the suspended processing agent composition and has an action of increasing the dispersibility of suspended particles, described above as category (4) of the coagulation inhibitor, is described below.

Examples thereof include organic carboxylic acids and organic polyaminocarboxylic acids as a constituent component of the bleaching agent, fixing agent or bleach-fixing agent described above, glycols and arylsulfonic acids in the developer system, alkanolamines added to the composition for development, and ammonium salts as a constituent component of the bleaching agent, fixing agent or bleach-fixing agent.

The suspended processing agent composition of the present invention can have a further prolonged stability by adding thereto an appropriate water-miscible alkanolamine. Moreover, when this amine is added, the development processing agent can be prevented from reduction in the sensitivity by aging during the storage.

When the suspended processing agent composition of the present invention is prepared, an alkanolamine liquid at a room temperature may be added either before or after adding a mixed powder into water, but it is usually preferred that the alkanolamine is added before adding the mixed powder into water.

Particularly effective alkanolamines are set forth below.

| | |
|---|---|
| A-1 | Triisopropanolamine |
| A-2 | Diisopropanolamine |
| A-3 | Monoisopropanolamine |
| A-4 | Diethanolamine. |

Among these effective alkanolamines, triisopropanolamine, diisopropanolamine and diethanolamine are more effective.

The amount of the alkanolamines added is from 0.05 to 3 mol, preferably from 0.1 to 2 mol, more preferably from 0.2 to 1 mol, per l of the processing agent composition. When the surface active agents represented by formulae (SI) and (SII) are used in combination with the alkanolamines, the effect can be more increased. In this case, the amounts of the surface active agents each is from 0.05 to 15 g, preferably from 0.2 to 10 g, more preferably from 0.5 to 5 g, per l of the processing agent composition, and the total amount thereof is from 0.1 to 25 g, preferably from 0.5 to 15 g, more preferably from 1.0 to 10 g, per l of the composition.

Examples of the monohydric or polyhydric carboxylic acid having coagulation preventive effect in the production process of the concentrated processing agent of the present invention, include dibasic acids such as oxalic acid, malonic acid, succinic acid, glutaric acid, adipic acid and pimelic acid, saturated monobasic acids such as fumaric acid, acetic acid, propionic acid, butyric acid, valerianic acid, caproic acid, lauric acid, myristic acid and palmitic acid, unsaturated fatty acids such as oleic acid, arachidonic aid and linoleic acid, oxy acids such as tartaric acid and lactic acid, and aminopolycarboxylic acids such as ethylenediaminetetraacetic acid, diethylenetriaminepentaacetic acid, iminodiacetic acid, nitrilotriacetic acid, N,N,N-trimethylenephosphonic acid, diaminopropanetetraacetic acid and ethylenediaminoorthohydroxyphenylacetic acid.

The amount of the carboxylic acids added varies depending on the kind of the objective processing solution, but it is usually from 0.1 to 100 g, preferably from 0.2 to 10 g in the case of a composition for development, from 0.5 to 60 g in the case of a composition for bleaching, bleach-fixing or fixing, more preferably from 0.4 to 3 g in the case of a composition for development, and from 1.0 to 30 g in the case of a composition for bleaching, bleach-fixing or fixing. The above-described carboxylic acids may be used in combination of two or more thereof.

The constituent components of the concentrated processing agent composition as an objective of the production process of the present invention, other than the surface active agent, the water-soluble polymer and the hydrophilic organic compounds in the category (3) and (4) which all are described in the foregoing, are described below.

In the case when the processing agent composition produced by the production process of the present invention is a color development processing agent composition, the composition contains a known aromatic primary amine color developing agent. Preferred examples thereof include p-phenylenediamine derivatives and representative examples thereof are set forth below, however, the present invention is by no means limited thereto.

1) N,N-Diethyl-p-phenylenediamine
2) 4-Amino-N,N-diethyl-3-methylaniline
3) 4-Amino-N-(β-hydroxyethyl)-N-methylaniline
4) 4-Amino-N-ethyl-N-(β-hydroxyethyl)aniline
5) 4-Amino-N-ethyl-N-(β-hydroxyethyl)-3-methylaniline
6) 4-Amino-N-ethyl-N-(3-hydroxypropyl)-3-methylaniline
7) 4-Amino-N-ethyl-N-(4-hydroxybutyl)-3-methylaniline
8) 4-Amino-N-ethyl-N-(β-methanesulfonamidoethyl)-3-methylaniline
9) 4-Amino-N,N-diethyl-3-(β-hydroxyethyl)aniline
10) 4-Amino-N-ethyl-N-(β-methoxyethyl)-3-methylaniline
11) 4-Amino-N-(β-ethoxyethyl)-N-ethyl-3-methylaniline
12) 4-Amino-N-(3-carbamoylpropyl-N-n-propyl-3-methylaniline
13) 4-Amino-N-(4-carbamoylbutyl-N-n-propyl-3-methylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidinecarboxamide Among the above-described p-henylenediamine derivatives, preferred are Compounds 5), 6), 7), 8) and 12). These p-phenylenediamine derivatives as a solid material are usually in the form of a salt such as sulfate, hydrochloride, sulfite, naphthalenedisulfonate or p-toluenesulfonate. The processing agent composition is mixed with water on use at a predetermined ratio to obtain a development replenisher and the aromatic primary amine developing agent is added to the composition to have a concentration of preferably from 2 to 200 mmol, more preferably from 12 to 200 mmol, still more preferably from 12 to 150 mmol, per l of the developer prepared by diluting the composition with water.

The development processing agent composition produced by the process of the present invention may contain slight or substantially no sulfite ion depending on the objective light-sensitive material, because the sulfite ion has an outstanding preservative action but on the other hand, depending on the objective light-sensitive material, adversely affects the photographic performance during the color development.

Also, hydroxylamine may or may not be contained in the constituent components of the composition depending on the kind of the objective light-sensitive material, because hydroxylamine has a function as a preservative of the developer and at the same time, due to its own silver development activity, adversely affects the photographic property.

The development processing agent composition preferably contains an inorganic preservative such as hydroxylamine derivatives or sulfite ion in such an amount that the above adverse effect is not taken, or an organic preservative. The organic preservative indicates an organic compound in general which is contained in the processing solution of a light-sensitive material to reduce the deterioration rate of the aromatic primary amine color developing agent, more specifically, organic compounds having a function of preventing the air oxidation or the like of the color developing agent. Examples of the organic preservative which is particularly effective include hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oxides, diamide compounds and condensed amines. These are disclosed in JP-A-63-4235 (the term "JP-A" as used herein means an "unexamined published Japanese patent application"), JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496 (the term "JP-B" as used herein means an "examined Japanese patent publication").

Other preservative may be added, if desired, such as various metals described in JP-A-57-44148 and JP-A-57-53749, salicylic acids described in JP-A-59-180588, alkanolamines described in JP-A-54-3532, polyethyleneimines described in JP-A-56-94349 and aromatic polyhydroxy compounds described in U.S. Pat. No. 3,746,544. In particular, an alkanolamine other than the above-described alkanolamines, such as triethanolamine, a substituted or unsubstituted dialkylhydroxylamine such as disulfoethylhydroxylamine and diethylhydroxylamine, or an aromatic polyhydroxy compound is preferably added.

Among the organic preservatives, hydroxylamine derivatives are particularly preferred and are described in detail in JP-A-1-97953, JP-A-1-186939, JP-A-1-186940 and JP-A-1-187557. In particular, the combination use of a hydroxylamine derivative with an amine is preferred in view of improvement in stability of the color developer and stability at the continuous processing.

Examples of the amines include cyclic amines described in JP-A-63-239447, amines described in JP-A-63-128340 and amines described in JP-A-1-186939 and JP-A-1-187557.

The concentrated processing agent composition produced by the process of the present invention may contain chlorine ion, if desired. Many developers (in particular, the developer for color printing material or the developer for black-and-white bright room processing) in usual contain from $3.5\times10^{-2}$ to $1.5\times10^{-1}$ mol/l of chlorine ion, however, since chlorine ion is usually released into the developer as a by-product of the development, its addition is not necessary also in many cases. The amount of chlorine ion in the processing agent composition is set so that when a running equilibrium composition is reached, the chlorine ion concentration in the development tank is in the above-described concentration level. If the chlorine ion concentration exceeds $1.5\times10^{-1}$ mol/l, it disadvantageously retards the development and the rapid processability and color density are impaired, whereas if the chlorine ion concentration is less than $3.5\times10^{-2}$ mol/l, undesired results come out in many cases in view of prevention of fogging.

With respect to the content of bromine ion in the concentrated processing agent composition produced by the process of the present invention, the situation is the same as in the chlorine ion content. The bromine ion content in the developer is preferably on the order of from 1 to $5\times10^{-3}$ mol/l in the case of processing of a light-sensitive material for photographing and $1.0\times10^{-3}$ mol/l or less in the case of processing of a printing material. The bromine ion may be added to the processing agent composition, if desired, to have a bromine ion concentration within the above-described range.

When the processing agent composition contains these ions, examples of the chlorine ion source material include sodium chloride, potassium chloride, ammonium chloride, lithium chloride, nickel chloride, magnesium chloride, manganese chloride and calcium chloride, and among these preferred are sodium chloride and potassium chloride.

Examples of the bromine ion source material include sodium bromide, potassium bromide, ammonium bromide, lithium bromide, calcium bromide, magnesium bromide, manganese bromide, nickel bromide, cerium bromide and thallium bromide, and among these preferred are potassium bromide and sodium bromide.

In the case when the light-sensitive material developed is a color printing paper, whiteness of the background of an image is critical as an image quality property and therefore, it is important to have a white finish in appearance using a brightening agent. The brightening agent is incorporated into a light-sensitive material due to its property, however, it may be permeated into the light-sensitive material from the processing solution at the development. In the latter case, the processing solution to which the brightening agent is added is appropriately selected depending on the property of the brightening agent so as to obtain high brightening effect. Accordingly, the brightening agent is sometimes added to a color developer having a high pH or sometimes added to a bleach-fixing solution or stabilizing bath so that it is not washed out during the processing but can be contained in the developed print in a large amount.

Stilbene-base brightening agents are generally used in many cases and among those, di(triazylamino)stilbene-base brightening agents and 4,4'-diamino-2,2'-disulfostilbene-base brightening agents are preferred.

The stilbene-based brightening agents represented by the following formula are preferably used.

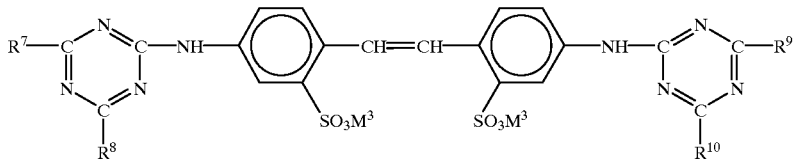

In the above formula, $R^7$ and $R^9$ each represents a hydrogen atom, an alkyl group having from not more than 2 carbon atoms, an alkoxy group having from not more than 2 carbon atoms or a hydroxyalkyl group having from not more than 2 carbon atoms, $R^8$ and $R^{10}$ each represents a substituted or unsubstituted amino group or an alkoxy group having from not more than 2 carbon atoms, with the substituent for the amino group being an alkyl group having from not more than 2 carbon atoms, a hydroxyalkyl group having from not more than 2 carbon atoms, a sulfoalkyl group having from not more than 2 carbon atoms or a phenyl group, and $M^3$ represents a hydrogen atom, a sodium atom or a potassium atom.

Specific examples of the stilbene-base brightening agent for use in the present invention are set forth below, however, the present invention is by no means limited thereto.

(F-1)

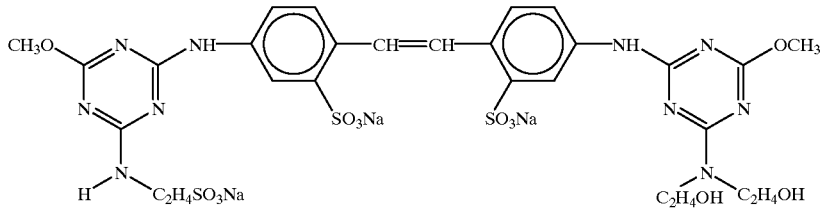

(F-2)

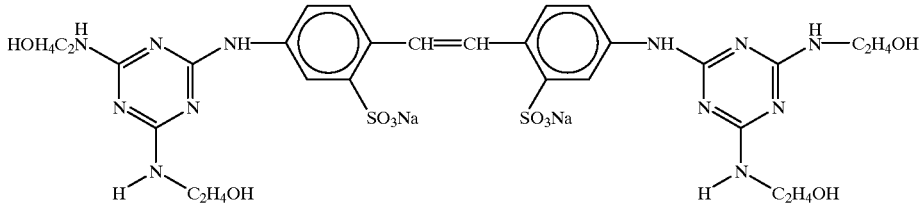

(F-3)

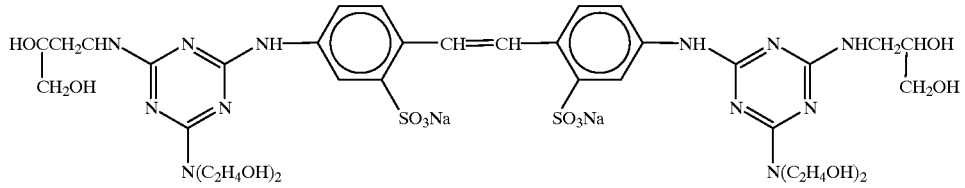

(F-4)

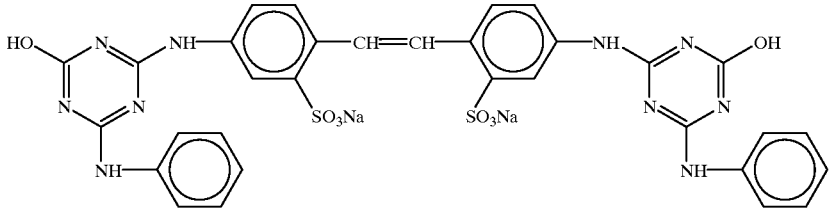

(F-5)

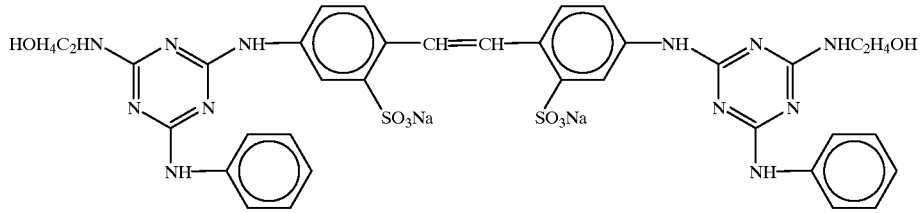

-continued
(F-6)
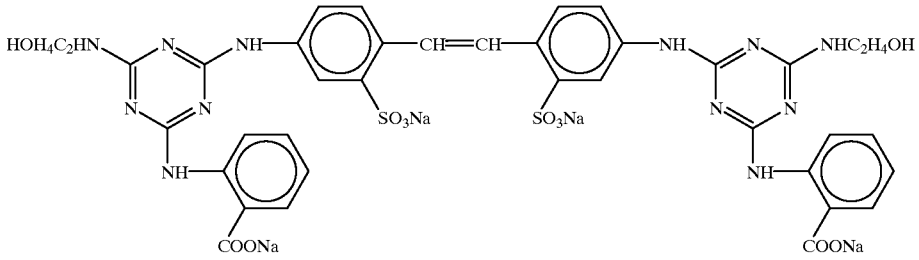
(F-7)
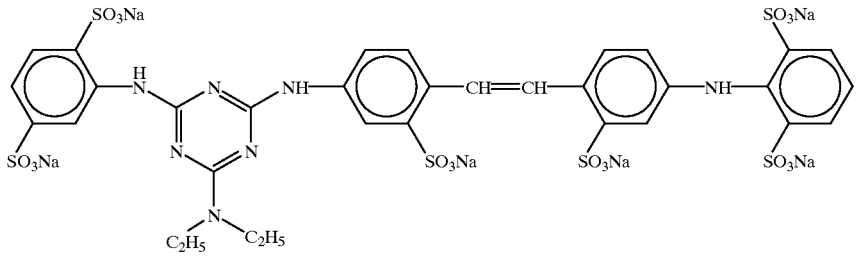
(F-8)
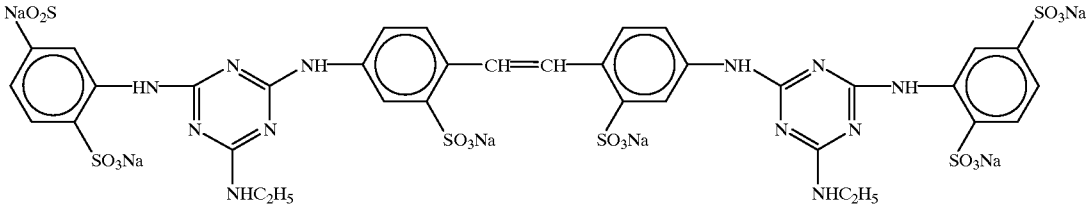
(F-9)
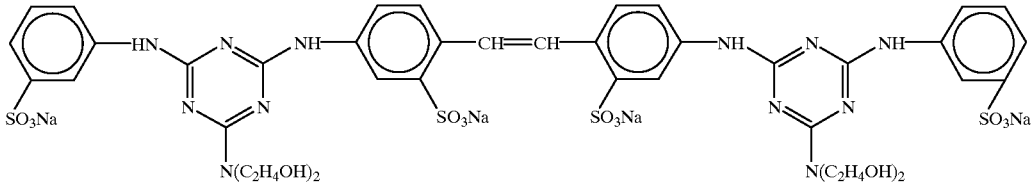
(F-10)
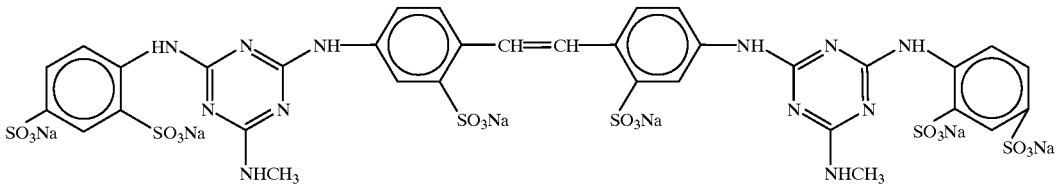
(F-11)
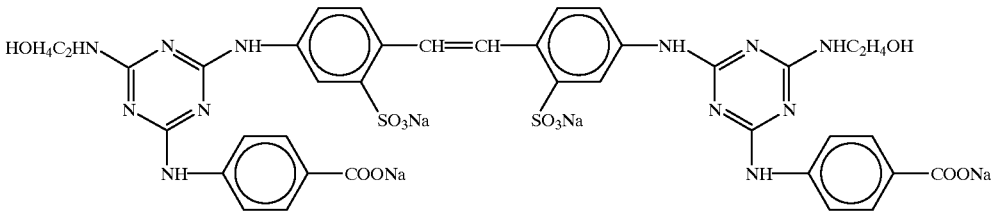

-continued
(F-12)
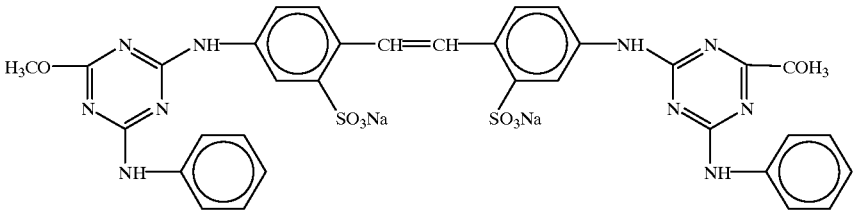
(F-13)
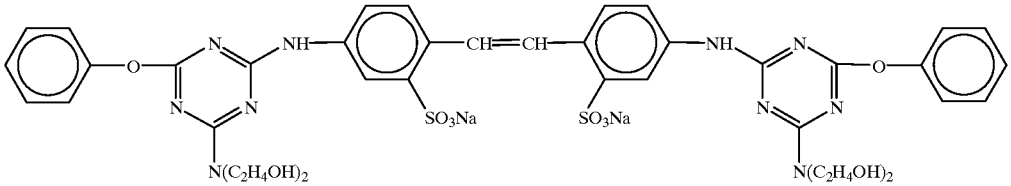
(F-14)
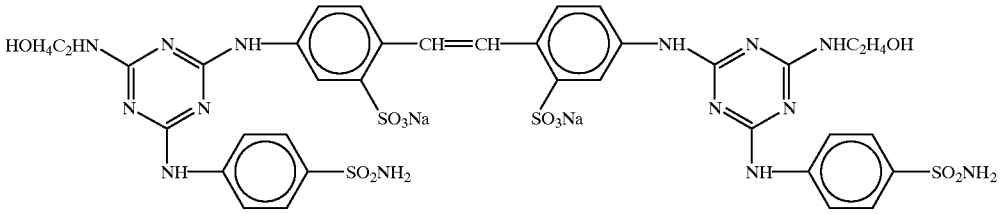
(F-15)
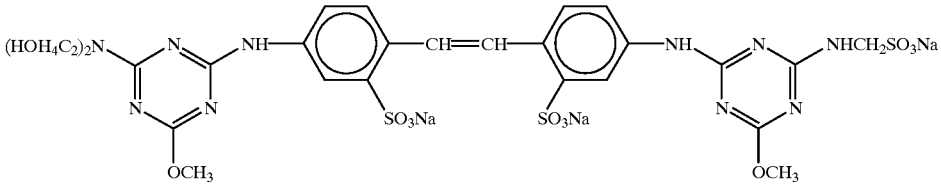
(F-16)
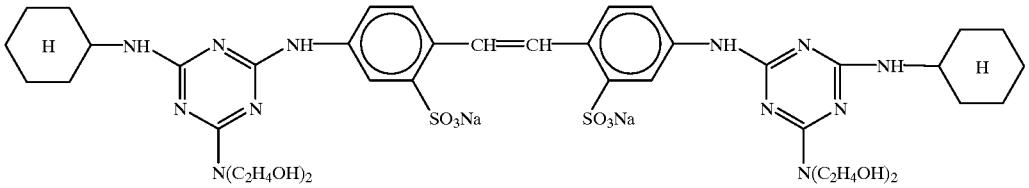
(F-17)
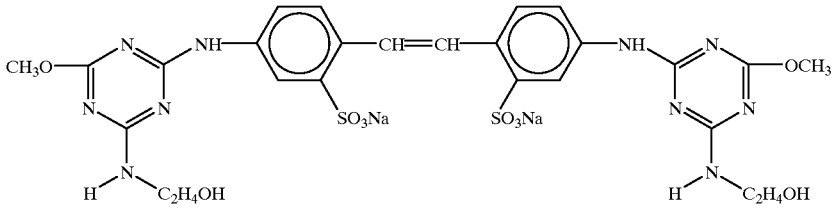

-continued (F-18)

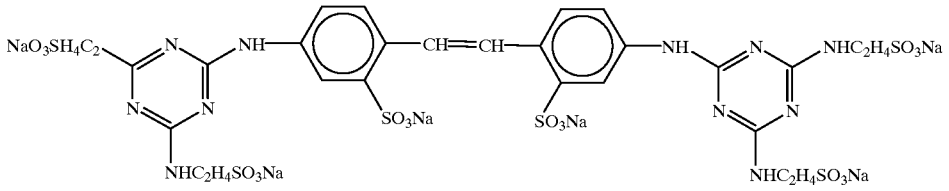

(F-19)

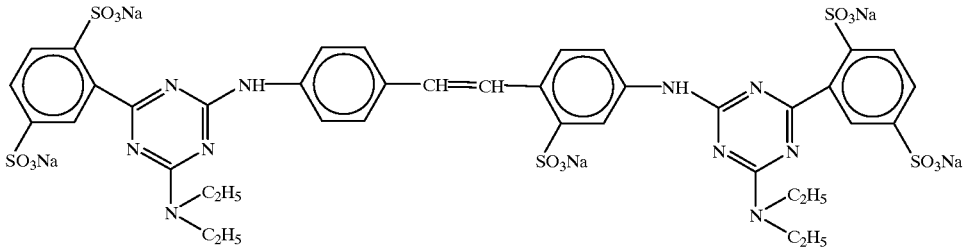

These compounds all are already known and easily available or easily synthesized by known methods.

The stilbene-base brightening agent can be added to any of a color developer, a processing agent composition for desilvering and a light-sensitive material. In the case when it is contained in the processing solution, the suitable concentration thereof is from $1\times10^{-4}$ to $5\times10^{-2}$ mol/l, more preferably from $2\times10^{-4}$ to $1\times10^{-2}$ mol/l. The processing agent composition as an objective of the process of the present invention is added in an amount determined so that the working developer can contain the brightening agent in this concentration level.

In the case when the processing agent composition as an objective of the process of the present invention is a color or black-and-white developer or a replenisher therefor, the pH thereof is set to be 10 or more, preferably from 10.1 to 13.5, more preferably from 10.1 to 12.5. In the case when the processing agent composition is used for processing a color negative light-sensitive material, the pH thereof is set to be preferably from 10.1 to 12.5, more preferably from 10.1 to 11.0. In the case when the processing agent composition is used for processing a color printing paper, the pH thereof is set to be preferably from 12.0 to 13.5. Other compounds known as a developer component can be added to adjust the pH in this range.

In order to keep the pH within the above-described range, various kinds of buffering agents are preferably used. Examples of the buffering agent which can be used include a carbonate, a phosphate, a borate, a tetraborate, a hydroxybenzoate, a glycyl salt, an N,N-dimethylglycin salt, a leucine salt, a norleucine salt, a guanine salt, a 3,4-dihydroxyphenylalanine salt, an alanine salt, an aminobutyric acid salt, a 2-amino-2-methyl-1,3-propanediol salt, a valine salt, a proline salt, a trishydroxyaminomethane salt and a lysine salt. Among these, a carbonate, a phosphate, a tetraborate and a hydroxybenzoate are advantageous in that they have excellent buffering ability in a high pH region of 9.0 or higher, cause no adverse effect (for example, fogging) even when they are contained in a color or black-and-white developer, and are cheap, and the use thereof is preferred.

The amount of the buffer added is controlled to have a concentration in the development replenisher prepared, of from 0.01 to 2.0 mol/l, preferably from 0.1 to 0.5 mol/l.

Specific examples of the buffering agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate), however, the present invention is by no means limited to these compounds.

The buffering agent is added to the composition to have a concentration in the development replenisher prepared by the dilution, of 0.1 mol/l or more, preferably from 0.1 to 0.4 mol/l.

The processing agent composition according to the present invention may contain other developer components, for example, various chelating agents as a precipitation inhibitor of calcium or magnesium or as a stability improving agent of the developer. Examples thereof include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and 1,2-dihydroxybenzene-4,6-disulfonic acid.

These chelating agents may be used in combination of two or more thereof, if desired.

The amount of the chelating agent is sufficient if it is large enough to sequester the metal ion in the developer, for example, the chelating agent is added in an amount of approximately from 0.1 to 10 g per l of the processing solution prepared.

The processing agent composition according to the present invention may contain any development accelerator, if desired.

Examples of the development accelerator which can be added, if desired, include thioether-base compounds described in JP-B-37-16088, JP-B-37-5987, JP-B-38-7826, JP-B-44-12380, JP-B-45-9019 and U.S. Pat. No. 3,813,247, p-phenylenediamine-base compounds described in JP-A-52-49829 and JP-A-50-15554, quaternary ammonium salts described in JP-A-50-137726, JP-B-44-30074, JP-A-56-156826 and JP-A-52-43429, amine-base compounds described in U.S. Pat. Nos. 2,494,903, 3,128,182, 4,230,796 and 3,253,919, JP-B-41-11431, U.S. Pat. Nos. 2,482,546, 2,596,926 and 3,582,346, polyalkylene oxides described in JP-B-37-16088, JP-B-42-25201, U.S. Pat. No. 3,128,183, JP-B-41-11431, JP-B-42-23883 and U.S. Pat. No. 3,532,501, 1-phenyl-3-pyrazolidones and imidazoles.

The processing agent composition according to the present invention may contain any antifoggant, if desired. Examples of the antifoggant which can be used include alkali metal halides such as sodium chloride, potassium bromide and potassium iodide, and organic antifoggants. Representative examples of the organic antifoggant include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The amount of the antifoggant added is from 0.01 mg to 2 g per 1 l of the solution prepared by diluting the processing agent composition with water. In the case when the objective photographic light-sensitive material is a silver iodobromide light-sensitive material, the amount added is preferably 0.2 mg to 0.2 g for mercaptoazoles and from 1 mg to 2 g for non-mercaptoazoles, and in the case when the objective photographic light-sensitive material is a silver chlorobromide, silver bromide or silver chloride light-sensitive material, it is preferably from 0.01 mg to 0.3 g for mercaptoazoles and from 0.1 mg to 1 g for non-mercaptoazoles, each per 1 l of the solution prepared by diluting the processing agent composition with water.

If desired, various surface active agents such as an alkylsulfonic acid, an arylsulfbnic acid, an aliphatic carboxylic acid and an aromatic carboxylic acid, may also be added.

In the case when the production process of the present invention is applied to a black-and-white development processing agent, examples of the developing agent include hydroquinone, hydroquinonesulfonic acid (or a sodium or potassium salt), chlorohydroquinone, N-methyl-p-aminophenol (a sulfate, etc.), p-aminophenol (a sulfate, etc.), 1-phenyl-3-pyrazolidone, 1-phenyl-4-methyl-4-hydroxymethyl-3-pyrazolidone, 1-phenyl-4-methyl-3-pyrazolidone, catechol, L-ascorbic acid, erythorbic acid, methylhydroquinone and hydroquinone-2,5-disulfonic acid (or a sodium or potassium salt), and these are used individually or in combination of two or more thereof.

The content of the developing agent is from 0.01 to 0.4 mol, preferably from 0.05 to 0.4 mol in the case of rapid processing and from 0.01 to 0.1 mol in the case of normal processing, per 1 l of the working solution obtained by diluting the composition.

The preservative mainly used in the color developer is a hydroxylamine derivative as described above, whereas in the black-and-white developer, sodium sulfite or potassium sulfite is used at a concentration of from 0.01 to 1.2 mol, preferably from 0.1 to 0.8 mol, per 9 of the working solution.

With respect to the buffer salt, the pH, the chelating agent (hard water softener) and the antifoggant, the description above is common between the processing agent composition for color development and the processing agent composition for black-and-white development.

By the production process of the present invention, a concentrated processing agent composition of any of the known bleaching solution, the known bleach-fixing solution and the known fixing solution is produced.

The bleaching agent for use in a processing agent composition for the bleaching or bleach-fixing solution may be any of bleaching agents, however, an organic complex salt (e.g., a salt of aminopolycarboxylic acids) of iron(III), an organic acid such as citric acid, tartaric acid and malic acid, a persulfate and a perhydrogen oxide are preferred.

Among these, the organic complex salt of iron(III) is more preferred in view of rapid processing and prevention of environmental pollution. Examples of the aminopolycarboxylic acid useful for forming an organic complex salt of iron(III) include ethylenediaminedisuccinic acid (SS form), N-(2-carboxylatoethyl)-L-aspartic acid, β-alaninediacetic acid, methyliminodiacetic acid, these each having biodegradability, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid and glycol ether diaminetetraacetic acid. These compounds may be in the form of a sodium, potassium, lithium or ammonium salt. Among these compounds, ethylenediaminedisuccinic acid (SS form), N-(2-carboxylatoethyl)-L-aspartic acid, β-alaninediacetic acid, ethylenediaminetetraacetic acid, 1,3-diaminopropanetetraacetic acid and methyliminodiacetic acid are preferred because their iron(III) complex salt exhibits good photographic property. The ferric ion complex salt of these may be used in the form of a complex salt or a ferric ion complex salt may be formed in a solution using a ferrate(III) such as ferric sulfate, ferric chloride, ferric nitrate, ammonium ferric sulfate or ferric phosphate, and a chelating agent such as aminopolycarboxylic acid. Or, the chelating agent may be used in excess of the amount necessary for forming a ferric ion complex salt. The amount of the iron complex added is from 0.01 to 1.0 mol/l, preferably from 0.05 to 0.50 mol/l, more preferably from 0.10 to 0.50 mol/l, still more preferably from 0.15 to 0.40 mol/l, based on the processing solution prepared by diluting the composition with water.

The processing agent composition used as a bleach-fixing solution for the color processing or as a fixing solution for color or black-and-white processing may contain a known fixing agent, namely, a water-soluble silver halide dissolving agent, and examples thereof include thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and thioureas. These may be used alone or as a mixed solution of two or more thereof. Further, a specific bleach-fixing solution comprising a combination of a fixing agent and a halide such as a large quantity of potassium iodide, described in JP-A-55-155354, may also be used. In the present invention, a thiosulfate, particularly ammonium thiosulfate, is preferably used. The amount of the fixing agent is preferably from 0.3 to 2 mol, more preferably from 0.5 to 1.0 mol, per 1 l of the processing solution prepared.

The bleach-fixing solution or fixing solution prepared preferably has a pH of from 3 to 8, more preferably from 4 to 7. If the pH is less than this range, although the desilvering property may be improved, deterioration of the solution or formation of the cyan dye into a leuco dye is accelerated, whereas if the pH exceeds the above-described range, the desilvering is retarded and stains are readily generated.

The bleaching solution prepared has a pH of 8 or less, preferably from 2 to 7, more preferably from 2 to 6. If the pH is less than this range, deterioration of the solution or formation of the cyan dye into a leuco dye is accelerated, whereas if the pH exceeds the above-described range, the desilvering is retarded and stains are readily generated.

In order to adjust the pH, a hydrochloric acid, a sulfuric acid, a nitric acid, a bicarbonate, ammonia, potassium hydroxide, sodium hydroxide, sodium carbonate or potassium carbonate may be added.

The bleach-fixing agent composition may additionally contain a brightening agent which is described above, a defoaming agent, a surface active agent or an organic solvent such as polyvinylpyrrolidone and methanol.

The bleach-fixing or fixing agent composition preferably contains a preservative and examples thereof include sulfite ion-releasing compounds such as sulfite (e.g., sodium sulfite, potassium sulfite, ammonium sulfite), bisulfite (e.g., ammonium bisulfite, sodium bisulfite, potassium bisulfite) and metabisulfite (e.g., potassium metabisulfite, sodium metabisulfite, ammonium metabisulfite), and arylsulfinic acids such as p-toluenesulfinic acid and m-carboxybenzenesulfinic acid. These compounds each is preferably added, in terms of sulfite ion or sulfinate ion, in an amount of from about 0.02 to 1.0 mol/l.

As the preservative, in addition to the above-described compounds, an ascorbic acid, a carbonyl bisulfite adduct or a carbonyl compound may also be added.

Further, a buffering agent, a brightening agent, a chelating agent, a defoaming agent or an antifungal may also be added, if desired.

The suspended processing agent composition produced by the process of the present invention is characterized in, from the compositional aspect, that it is particularly highly concentrated and, from the technical aspect, that the saturation solubility as a limit in conventional concentrating is overcome. The degree of concentrating is such that the composition is concentrated to approximately from 1 to 20 times, preferably from 2 to 10 times, more preferably from 3 to 6 times, the concentration of the solution in the state of actual use, namely, the development replenisher or mother solution (tank solution).

The concentrated processing agent composition produced by the process of the present invention advantageously has a so-called one-part structure which is an embodiment of containing all components of the working solution in one solution. However, in the case when the constituent components are preferably prevented from contact with each other for a long period of time, a processing agent composition having a two- or three-part structure may be produced by separating the constituents components into two or more liquid agents (usually called one-, two- or three-part structure in the art using the term determined by the International Standard ISO5989). Even when the constituent components are divided into parts, the effect or characteristics of the invention are not lost. In this case, the process of the present invention can be applied to the production of each part.

When color development is performed using a photographic processing solution prepared from the concentrated processing agent composition produced by the process of the present invention, the processing temperature with the color developer is preferably 30° C. or higher, more preferably from 35 to 55° C., still more preferably from 38 to 45° C. The processing time is, in the case of development of a color printing material, preferably 60 seconds or less, more preferably from 15 to 45 seconds, still more preferably from 5 to 20 seconds. The replenishing amount is preferably smaller, but it is suitably from 20 to 600 ml, preferably from 30 to 120 ml, more preferably from 15 to 60 ml, per 1 $m^2$ of the light-sensitive material.

In the case of color development of a color negative or color reversal film, the processing time is 6 minutes or less, preferably from 1 to 4 minutes, more preferably from 1 to 3 minutes and 15 seconds for the color negative film and from 1 to 4 minutes for the color reversal film.

The processing time in the bleach-fixing with the processing agent composition produced by the process of the present invention is from 5 to 240 seconds, preferably from 10 to 60 seconds. The processing temperature is from 25 to 50° C., preferably from 30 to 45° C. The replenishing amount is from 20 to 250 ml, preferably from 30 to 100 ml, more preferably from 15 to 60 ml, per 1 $m^2$ of the light-sensitive material.

After desilvering such as fixing or bleach-fixing, water washing and/or stabilization is generally performed.

The amount of water in the water washing step can be set over a wide range according to the characteristics (e.g., due to the material used such as a coupler) or use of the light-sensitive material, the temperature of washing water, the number of water washing tanks (stage number) or other various conditions. Among these, the relation between the number of water washing tanks and the amount of water in a multi-stage countercurrent system can be obtained according to the method described in *Journal of the Society of Motion Picture and Television Engineers*, Vol. 64, pp. 248–253 (May, 1955). The stage number of the multi-stage countercurrent system in usual is preferably from 3 to 15, more preferably from 3 to 10.

According to the multi-stage countercurrent system, the amount of washing water can be greatly reduced but due to the increase in the residence time of water in the tank, a problem is caused such that bacteria proliferate and the floating matters generated adhere to the light-sensitive material. In order to solve such a problem, a method of reducing calcium or magnesium described in JP-A-62-288838 can be very effectively used. Further, isothiazolone compounds or thiabendazoles described in JP-A-57-8542, chlorine-based bactericides such as sodium chlorinated isocyanurate described in JP-A-61-120145, or bactericides such as benzotriazole described in JP-A-61-267761, copper ion and those described in Hiroshi Horiguchi, *Bokin. Bobai-Zai no Kaaaku* (*Chemistry of Bactericide and Antifungal*), Sankyo Shuppan (1986), *Biseibutsu no Mekkin. Sakkin, Bobai-Gijutsu* (*Germicidal. Bactericidal and Antifungal Technology of Microorganism*) compiled by Eisei Gijutsu Kai, issued by Kogyo Gijutsu Kai (1982), and *Bokin-Bobai Zai Jiten* (*Lexicon of Bactericide and Antifungal*) compiled by Nippon Bokin Bobai Gakkai (1986), may be also used.

Furthermore, in order to prevent discoloration of a dye or generation of stains by inactivating the residual magenta coupler, aldehydes such as formaldehyde, acetaldehyde and pyruvic aldehyde, methylol compounds and hexamethylenetetramine described in U.S. Pat. No. 4,786,583, hexahydrotriazines described in JP-A-2-153348, formaldehyde bisulfite adducts described in U.S. Pat. No. 4,921,779, and azolylmethylamines described in EP-A-504609 and EP-A-519190 may be added.

The washing water may contain a surface active agent as a water cutting agent or a chelating agent represented by EDTA as a hard water softener.

The processing with a stabilizing solution may be performed following the above-described water washing or directly without passing through the water washing step. The stabilizing solution contains a compound having a function of stabilizing the image, for example, an aldehyde compound represented by formalin, a buffering agent for adjusting the pH of layer to be suitable for the dye stabilization, or an ammonium compound. In order to prevent proliferation of bacteria in the solution or impart an antifungal property to the processed light-sensitive material, a bactericide or antifungal described above may be added. Further, a surface active agent, a brightening agent or a hardening agent may also be added.

In the processing of a light-sensitive material using a concentrated processing agent composition produced by the process of the present invention, when the stabilization is performed directly without passing through the water washing step, any known method described in JP-A-57-8543, JP-A-58-14834 and JP-A-60-220345 may be used.

Further, a chelating agent such as 1-hydroxyethylidene-1,1-diphosphonic acid and ethylenediaminetetramethylenephosphonic acid, magnesium or a bismuth compound is preferably used.

A so-called rinsing solution is similarly used as a water washing solution or stabilizing solution for use after the desilvering.

In the water washing or stabilization step, the pH is preferably from 4 to 10, more preferably from 5 to 8. The processing temperature may be set variously according to the use and characteristics of the light-sensitive material, but it is generally from 20 to 50° C., preferably from 25 to 45° C. The production process of the present invention can be applied to the production of a processing agent composition for the stabilizing solution. However, the effect of the present invention on the inherently dilute washing water or stabilizing solution is not large as compared with the effect on various processing agent compositions described above.

In subsequent to the water washing and/or stabilization, drying is performed. The drying can be expedited by absorbing water with squeeze rollers or cloth immediately after delivery from the water washing bath so as to reduce the amount of water carried over on the image layer. An improvement means from the dryer side is naturally effective, but the drying can also be accelerated by elevating the temperature or modifying the shape of blasting nozzles to intensify the drying blow. Further, as described in JP-A-3-157650, the drying can also be accelerated by controlling the blowing angle of air to the light-sensitive material or eliminating the discharge blow.

The concentrated processing agent composition produced by the process of the present invention is further advantageous in that a simple development processing system which is highly safe in view of both the environment and working, can be realized if this composition is integrated into the system. For example, in the development of a silver halide color light-sensitive material in an automatic developing machine, a container filled with the development processing agent composition of the present invention is installed into the developing machine, the contents are transferred into a developer replenishing tank, the inside of the container is spray cleaned to wash out the chemical components adhering to the wall of the container, and the water used in the cleaning is used for the preparation of the replenisher.

The material for the container of the processing agent composition produced by the process of the present invention is selected from the materials which are inert and highly stable to the processing agent composition, have an oxygen barrier property highly enough to prevent air oxidation from the production of the processing agent composition until the use, have a recycling suitability of the waste container and in the case of a development processing agent composition, scarcely penetrate carbon dioxide in air so as not to cause reduction of pH during the storage.

Suitable examples of the container material satisfying the above-described requirements include a material comprising a single structure of polyester resin, acrylic resin, ABS resin, epoxy resin, polyamide resin such as nylon, polyurethane resin, polystyrene resin, polycarbonate resin, PVA resin such as modified (partially saponified) polyvinyl alcohol, polyvinyl chloride, polyvinylidene chloride or polyethylene resin, and a composite material comprising a laminate of these resin materials. Among these, preferred in view of the practical use are polyethylene terephthalate, polyethylene naphthalate, a laminate material of polyethylene or polypropylene with nylon, a laminate material of polyethylene or polypropylene with polyvinyl alcohol, and a laminate material of polyethylene or polypropylene with aluminum. The container is more preferably formed of a single material, still more preferably a single material of polyethylene terephthalate or polyethylene naphthalate.

The shape and structure of the container for filling the concentrated liquid processing agent composition produced by the process of the present invention may be variously designed depending on the purpose and, in addition to the general fixed bottle structure, a freely stretchable structure described in JP-A-58-97046, JP-A-63-50839, JP-A-1-235950 and JP-A-63-45555, or a structure with a flexible partition described in JP-A-58-52065, JP-A-62-246061 and JP-A-62-134626 may also be used.

The light-sensitive material as the objective in use of the processing agent composition produced by the process of the present invention is described below.

The silver halide used in the light-sensitive material for use in the present invention may be silver chloride, silver bromide, silver (iodo)chlorobromide or silver iodobromide, however, for achieving rapid processing, silver chlorobromide or silver chloride emulsion containing substantially no silver iodide and having a silver chloride content of 98 mol % or more is preferably used. The term "contain substantially no silver iodide" as used herein means that the silver iodide content is preferably 0.1 mol % or less, more preferably 0.01 mol % or less, still more preferably nil.

The color light-sensitive material for use in photographing, such as a multi-layer color negative film or color reversal film, uses tabular grains or non-tabular multiple structure grains each having an inner structure mainly comprising silver iodobromide.

The high-sensitivity black-and-white photographic light-sensitive material, such as medical or industrial X-ray film or negative film for camera work, uses silver bromide, silver (iodo)chlorobromide or silver iodobromide, particularly silver iodobromide.

The photographic light-sensitive material as a printing material in the photomechanical process preferably uses, for the figuration work, silver chlorobromide or silver chloride emulsion having a silver chloride content of 70 mol % or more. When the light-sensitive material is reduced in the sensitivity for facilitating the work in a bright room, silver chlorobromide, silver chloride or silver chlorobromoiodide emulsion subjected to crystallization in the presence of a polyvalent metal halide complex salt such as iridium salt or rhodium salt is preferably used. For the preparation of a print master drawing, such as dot resolution photographing or color resolution photographing, a silver chlorobromide or silver bromide emulsion is used, and for the preparation of a line or halftone image original by a scanner, a silver chlorobromide, silver chloride or silver chlorobromoiodide emulsion is preferably used.

In order to improve the sharpness or the like of an image, the light-sensitive material for use in the present invention preferably contains in a hydrophilic colloid layer a dye (particularly, an oxonol-base dye) capable of being decolorized by the processing, described in EP-A-447490, pp. 27–76, so that the light-sensitive material can have an optical reflection density at 680 nm of 0.70 or more, or contains in a waterproofing resin layer of the support 12 wt % or more (preferably 14 wt % or more) of titanium oxide subjected to surface treatment with a di-, tri- or tetrahydric alcohol (e.g., trimethylolethane).

The light-sensitive material for use in the present invention preferably contains an antifungal described in JP-A-63-271247 so as to prevent various mold or bacteria from proliferation in the hydrophilic colloid layer to deteriorate the image.

As the support of the light-sensitive material for use in the present invention, cellulose triacetate, poly(ethylene terephthalate) or poly(ethylene naphthalate) is used in the case of a light-sensitive material film for photographing, and a paper (resin coated paper) having laminated thereon polyethylene kneaded with a white pigment or a poly(ethylene terephthalate) film kneaded with a white pigment for display is used in the case of a color printing material.

The light-sensitive material for use in the present invention may be exposed to either visible light or infrared light. The exposure may be either the low illuminance exposure or the high illuminance short-time exposure. In the latter case, a laser scanning exposure method where the exposure time per one picture element is less than $10^{-4}$ second, is preferred.

With respect to the silver halide emulsion, other materials (for example, additives) and the photographic constituent layers (for example, layer arrangement) applied to the light-sensitive material for use in the present invention and further, the processing method and the processing additives used for processing the light-sensitive material, those described in EP-A-355660, JP-A-2-33144, JP-A-62-215272 and Table I below may be preferably used.

TABLE I

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col.-p. 649, right col. | pp. 866–868 |
| 4. Brightening agent | p. 24 | p. 647, right col. | p. 868 |
| 5. Light absorbent, filter dye, UV absorbent | pp. 25–26 | p. 649, right col.-p. 650, left col. | p. 873 |
| 6. Binder | p. 26 | p. 651, left col. | pp. 873–874 |
| 7. Plasticizer, lubricant | p. 27 | p. 650, right col. | p. 876 |
| 8. Coating aid, surface active agent | pp. 26–27 | p. 650, right col. | pp. 875–876 |
| 9. Antistatic agent | p. 27 | p. 650, right col. | pp. 876–877 |
| 10. Matting agent | | | pp. 878–879 |

As the cyan coupler, those described in JP-A-2-33144, EP-A-333185 and JP-A-64-32260 may be used.

The cyan, magenta or yellow coupler is preferably impregnated into a loadable latex polymer (described, for example, in U.S. Pat. No. 4,203,716) in the presence (or in the absence) of a high boiling point organic solvent shown in Table I above or dissolved together with a water-insoluble and organic solvent-soluble polymer, and then emulsion-dispersed in an aqueous hydrophilic colloid solution.

Preferred examples of the water-insoluble and organic solvent-soluble polymer include homopolymers and copolymers described in U.S. Pat. No. 4,857,449, columns 7 to 15, and International Patent Publication WO88/00723, pages 12 to 30. In particular, methacrylate- or acrylamide-base polymers are preferred in view of the image stability.

The light-sensitive material for use in the present invention preferably contains a color image preservability improving compound described in EP-A-277589, in combination with a pyrazoloazole coupler, a pyrrolotriazole coupler or an acylacetamide-type yellow coupler.

As the cyan coupler, in addition to the phenol-type couplers and the naphthol-type couplers described in known publications in Table I above, the cyan couplers described in JP-A-2-33144, EP-A-333185, JP-A-64-32260, EP-A-456226, EP-A-484909, EP-A-488248 and EP-A-491197 are preferred.

As the magenta coupler of the light-sensitive material for use in the present invention, in addition to the 5-pyrazolone-base magenta couplers described in known publications in Table I above, those described in International Patent Publication Nos. WO92/18901, WO92/18902 and WO92/18903 are preferred. Other than these 5-pyrazolone magenta couplers, known pyrazoloazole-type couplers may be used in the present invention and in particular, pyrazoloazole couplers described in JP-A-61-65245, JP-A-61-65246, JP-A-61-14254, EP-A-226,849 and EP-A-294785 are preferred in view of the hue, the image stability and the color forming property.

As the yellow coupler, known acylacetanilide-type couplers are preferred and those described in EP-A-447969, JP-A-5-107701, JP-A-5-113642, EP-A-482552 and EP-A-524540 are more preferred.

With respect to the color light-sensitive material as the object in use of the suspended processing agent composition produced by the process of the present invention and the processing method therefor, in addition to the methods described in Table I above, the processing materials and the processing methods described in JP-A-2-207250, page 26, right lower column, line 1 to page 34, right upper column, line 9, and JP-A-4-97355, page 5, left upper column, line 17 to page 18, right lower column, line 20 are preferred.

The present invention is described below in greater detail with reference to the Examples, however, the present invention should not be construed as being limited thereto.

EXAMPLE 1

A 5-fold concentrated composition of a development replenisher for color printing paper is prepared as follows by the process of the present invention or the sequential dissolution method for comparison.

[Constitution of 5-fold concentrated composition of development replenisher for color printing paper]

| | |
|---|---|
| Ethylenediaminetetraacetic acid | 20 g |
| KOH (50 wt %) | 70 g |
| Sodium sulfite | 1 g |
| Triisopropanolamine (85 wt %) | 80 g |
| Sodium bromide | 0.05 g |
| Surface active agent (siloxane-base) | 0.5 g |
| Triazinyldiaminostilbene-base brightening agent (Hakkol FWA-SF produced by Showa Kagaku KK) | 25 g |
| Disodium N,N-bis(sulfonato-ethyl)hydroxylamine | 55 g |
| Disodium 4,5-dihydroxybenzene-1,3-disulfonate | 2.5 g |

-continued

| | |
|---|---|
| N-Ethyl-N-(β-methanesulfonamidoethyl)-3-methyl-4-aminoaniline.3/2 sulfate. monohydrate | 75 g (0.17 mol) |
| Potassium carbonate | 130 g |
| Water to make in total | 1,000 ml |

[Preparation-1 of processing agent composition: sequential dissolution method (Comparative Example)]

In an open system of a work room at normal temperature and normal humidity, the components in the formulation above from the top to the developing agent (N-ethyl-N-(β-methanesulfonamidoethyl)-3-methyl-4-aminoaniline·3/2 sulfate·monohydrate) were sequentially added in the order described while stirring to a mixing tank containing 600 ml of soft water adjusted to a temperature of 25° C., and the mixture was thoroughly stirred to dissolve. Finally, potassium carbonate was added and after 5 minutes, the temperature reached 50° C. and a slurry of suspended matters was obtained. Water was further added to make a total amount of 1 l and from the initiation of the addition, the mixture was stirred for 15 minutes to accomplish a composition having flowability. While keeping the suspended composition in the mixing tank in the visually homogeneous dispersion state by stirring, the composition was quickly transferred to four polyethylene terephthalate-made narrow-mouthed bottles each having an inner volume of 270 ml, in an amount of 250 ml per one bottle in the open system. A cap made of the same material was engaged with the bottle by a screw and an Eval-polyester laminate tape was wound around the outer periphery thereof to seal the bottle. [Addition procedure in Comparative Example]

| | |
|---|---|
| Soft water | 600 ml |
| Ethylenediaminetetraacetic acid | 20 g |
| KOH (50 wt %) | 70 g |
| Sodium sulfite | 1 g |
| Triisopropanolamine (85 wt %) | 80 g |
| Sodium bromide | 0.05 g |
| Surface active agent (siloxane-base) | 0.5 g |
| Triazinyldiaminostilbene-base brightening agent (Hakkol FWA-SF produced by Showa Kagaku KK) | 25 g |
| Disodium N,N-bis(sulfonato-ethyl)hydroxylamine | 55 g |
| Disodium 4,5-dihydroxybenzene-1,3-disulfonate | 2.5 g |
| N-Ethyl-N-(β-methanesulfonamidoethyl)-3-methyl-4-aminoaniline.3/2 sulfate. monohydrate | 75 g (0.17 mol) |
| Potassium carbonate | 130 g |
| Water to make | 1,000 ml |

[Preparation-2 of processing agent composition: one-part powder mixing method (Invention)]

Among the composition components, triisopropanolamine and potassium hydroxide as liquid components were previously added to 600 ml of water for the preparation, and the temperature was adjusted to 25° C. While thoroughly stirring the mixed solution, the remaining solid constituent components all previously mixed to form a one-part agent were added thereto at once. The temperature was controlled to be from 25 to 30° C. by water cooling. To the mixed solution turned into a suspension after the addition, water was added to make 1,000 ml, thereby obtaining a suspended composition having flowability. The composition obtained was quickly transferred to four polyethylene terephthalate-made narrow-mouthed bottles each having an inner volume of 270 ml, which were the same in the constructive material and the shape as the bottles used in Comparative Example above, in an amount of 250 ml per one bottle. A cap made of the same material was engaged with the bottle by a screw and an Eval-polyester laminate tape was wound around the outer periphery thereof to seal the bottle.

[Preparation-3 of processing agent composition: two-part powder mixing method (Invention)]

Suspended compositions in a polyethylene-made narrow-mouth bottle were prepared in the same manner as in Preparation-2 of the processing agent composition except that the components exclusive of potassium carbonate were mixed to form a one-part agent in place of previously mixing all solid constituent components to form a one-part agent, and two parts of this mixture and potassium carbonate were simultaneously added to the mixing tank. The temperature was controlled to be from 25 to 30° C. by water cooling.

The thus-prepared (i) compositions by the sequential mixing method for comparison, and the suspended processing agent compositions of the present invention (ii) by the one-part powder mixing method or (iii) by the two-part agent mixing method, were tested for the evaluation of (1) flowability and aging stability, (2) solubility in chilled water and (3) photographic properties.

[Evaluation method]

(1) Flowability and Aging Stability of Processing Agent Composition

The flowability and aging stability of the processing agent compositions were evaluated in such a manner that each composition prepared and housed in a polyethylene terephthalate-made narrow-mouthed bottle having an inner volume of 270 ml was stored at room temperature for 90 days and the one-minute discharge rate and the amount of water sprayed were measured.

a. One-minute Discharge Rate

Each narrow-necked bottle was uncapped and immediately turned upside down, the weight of the composition discharged was recorded together with time, and the ratio (one-minute discharge rate) of the composition discharged within 1 minute to the entire composition was determined.

b. Amount of Water Sprayed

Then, the inside of the composition bottle still turned upside down was cleaned by shower spray, and the amount of water sprayed required for achieving visually complete cleaning was determined and used as the amount of water sprayed.

The one-minute discharge rate is an index for the flowability of the composition and a higher ratio reveals that the composition was stable and not solidified during the storage. The amount of water sprayed is also an index for the flowability of the composition and the smaller the water amount, the less the adhesion to the wall of the container and in turn, the higher the flowability.

(2) Solubility in Chilled Water

Each composition in a narrow-mouthed bottle was stored as it is at 35° C. for 60 days, 250 ml of the sample filled therein was then taken out from the narrow-mouthed bottled and added to 750 ml of water at 20° C., and the dissolution rate (time required until the mixture was visually judged to be transparent) was measured while rotating the disperser at 150 rpm.

(3) Photographic Properties of Processing Agent Composition

To each of the compositions newly prepared and the processing agent compositions each aged in a narrow-mouthed bottle, 10 g/l of potassium chloride was added, and the mixtures each was diluted to 5 times to prepare a color developer as a working solution. In the 5-fold dilution, the washing water used for the shower spray cleaning was also included. Further, in the case of the comparative sample where solid deposits were remaining and adhering to the container wall, the attachment was also contained in the working solution. As the control in the evaluation of the photographic properties, a standard sample solution prepared from the beginning according to the formulation of a working solution but not experienced concentration was used.

Sensitometry of each sample solution was performed using Fuji Color Paper FA Type 5. A color paper sample was subjected to gradation exposure through a three color separation filter for sensitometry in a sensitometer (Model FW, manufactured by Fuji Photo Film Co., Ltd.; color temperature of the light source: 3,200° K.). The exposure at this time was performed such that the exposure amount for an exposure time of 0.1 second was 250 CMS.

After the completion of exposure, the paper sample was processed with each sample developer through the processing steps shown below in an experimental development processing machine having divided multiple tanks. Each developed sample was determined on the reflection density by means of a reflection densitometer for sensitometry satisfying the geometric conditions in the measurement of reflection density according to ISO-5 Part 4, and a characteristic curve was obtained therefrom. On the characteristic curve, the gradation and the sensitivity at the foot part and the shoulder part were determined.

| Processing Step | Temperature (° C.) | Time (second) |
|---|---|---|
| Color development | 38 | 45 |
| Bleach-fixing | 38 | 45 |
| Rinsing (1) | 38 | 10 |
| Rinsing (2) | 38 | 10 |
| Rinsing (3) | 38 | 10 |
| Drying | 80 | 60 |

[Evaluation results]

(1) Flowability and Aging Stability of Processing Agent Composition

The evaluation results are shown in Table 1 below.

TABLE 1

| Sample | Discharge Rate (per 1 minute) | Amount of Water Sprayed (ml) | Remarks |
|---|---|---|---|
| Sequential mixing, newly prepared | 90% | 90 | comparative sample, new solution |
| One-part powder, newly prepared | 95% | 60 | Invention, new solution |
| Two-part powder, newly prepared | 95% | 65 | Invention, new solution |
| Sequential mixing, after aging | 70% | >1,000 | Comparative sample, aged |
| One-part powder, after aging | 92% | 70 | Invention, aged |
| Two-part powder, after aging | 93% | 65 | Invention, aged |

It is verified from both the discharge rate and the amount of water sprayed that the processing agent compositions prepared by the one-part or two-part powder mixing method of the present invention have high stability without causing any change even after aging at a high temperature. In the compositions for comparison prepared by the sequential mixing method, colored oily floating matters and precipitation of bulked particles were observed within one day after the preparation and the compositions could be visually judged to be unstable, which is also apparent from the results of the aging test in Table 1. In this comparative example, heat of neutralization was generated each time KOH, disodium 4,5-dihydroxybenzene-1,3-disulfonate and N-ethyl-N-(β-methanesulfonamidoethyl)-3-methyl-4-aminoaniline·3/2 sulfate.monohydrate were added, and heat of neutralization and heat of dissolution were generated at the addition of potassium carbonate, to thereby cause a large fluctuation of temperature as described above.

(2) Dissolution Rate in Chilled Water

The time required for the dissolution of each sample is shown below.

| | |
|---|---|
| Sequential mixing method (sample for Comparison) | 20 minutes or more |
| One-part powder mixing method (sample of Invention) | 6 minutes |
| Two-part powder mixing method (sample of Invention) | 5.5 minutes |

These results reveal that the processing agent composition formed into a suspension by the process of the present invention dissolves in chilled water at 20° C. within several minutes and has capability of not causing any difficulty in the winter season work at the processing laboratory, on the other hand, a specific heating operation is necessary in the winter season for the comparative sample prepared by the conventional method.

(3) Photographic Property of Processing Agent Composition

The working solutions obtained from the composition by the one-part or two-part powder mixing method, newly prepared or after aging, each exhibited the same sensitometry results in both the sensitivity and the gradation at the foot or shoulder part as those of the control sample newly prepared. On the other hand, in the case of comparative working solution samples obtained from the composition by the sequential mixing method, the sample newly prepared exhibited the same photographic properties as those of the control sample, however, the aged sample had generation of colored floating matters and insoluble matters due to coagulation of precipitates and a completely dissolved working solution could not be obtained. The working solution containing insoluble matters exhibited low sensitivity and low gradation and caused yellow stains.

The bleach-fixing solution and the rinsing solution used in the steps after the development step in the development processing of this Example each had the following composition.

Bleach-fixing Solution:

| | Tank Solution |
|---|---|
| Water | 500 ml |
| Ammonium thiosulfate (75 g/l) | 80 ml |
| Ethylenediaminetetraacetic acid | 4.4 g |
| Ammonium ethylenediaminetetra-acetato ferrate(III) dihydrate | 62.0 g |
| Ammonium sulfite monohydrate | 58.0 g |
| Ammonium bromide | 10.0 g |
| Imidazole | 0.04 mol |
| Acetic acid (50 wt %) | 66.0 ml |
| Nitric acid (67 wt %) | 18.29 g |
| Water to make | 1,000 ml |
| pH (25° C., adjusted with nitric acid) | 5.00 |

Rinsing Solution:

Ion exchanged solution (containing calcium and magnesium each in an amount of 3 ppm or less)

EXAMPLE 2

This example was performed to verify the effect by the addition of a coagulation inhibitor. In the preparation of a development processing agent composition for color printing paper by the one-part or two-part powder mixing method of the present invention in Example 1, a coagulation inhibitor was added to Solution A as shown in Table 2. The compositions were then tested on the solubility in chilled water (time required for the dissolution), the aging stability and the photographic capability. The times required for the dissolution in chilled water are shown in Table 2 below.

It is seen from Table 2 that the time required for the dissolution in chilled water was more reduced by the addition of a coagulation inhibitor of the present invention and various coagulation inhibitors of the present invention are effective.

The aging stability and the photographic property of the composition were almost the same as those of the samples prepared by the one-part or two-part powder mixing method of the present invention in Example 1 and no particular difference was observed, therefore, data are omitted.

TABLE 2

| Sample No. | Preparation Method | Coagulation Inhibitor Added: Kind | Coagulation Inhibitor Added: Amount (g) | Dissolution Time (min.) | Remarks |
|---|---|---|---|---|---|
| 1 | one-part powder mixing | (not added) | — | 6 | Invention |
| 2 | one-part powder mixing | Compound SI-25 | 5 | 5 | Invention |
| 3 | one-part powder mixing | Compound SII-56 | 5 | 5.5 | Invention |
| 4 | one-part powder mixing | carboxymethyl cellulose | 5 | 5.5 | Invention |
| 5 | one-part powder mixing | CMC1350 (Dicel) | 3 | 4.5 | Invention |
| 6 | two-part powder mixing | Compound SI-25 | 5 | 5.5 | Invention |
| 7 | two-part powder mixing | Compound SII-56 | 5 | 5 | Invention |
| 8 | two-part powder mixing | carboxymethyl cellulose | 5 | 5.5 | Invention |
| 9 | two-part powder mixing | CMC1350 (Dicel) | 3 | 4.5 | Invention |

EXAMPLE 3

In this example, a 3-fold concentrated processing agent composition was prepared by applying the processing process of the present invention to a suspended processing agent composition of general purpose bleaching replenisher for the color negative processing.

The bleaching replenisher used in the test had the following fundamental formulation.

[Constitution of 3-fold concentrated bleaching replenisher for color negative processing]

| | |
|---|---|
| Ammonium 1,3-PDTA ferrate(III) | 525 g |
| Ammonium bromide | 273.0 g |
| Ammonium nitrate | 54.6 g |
| Succinic acid | 234.0 g |
| Glutaric acid | 78.0 g |
| Adipic acid | 39.0 g |
| Maleic acid | 78.0 g |
| Water to make in total | 1.0 l |
| pH (adjusted with aqueous ammonia) | 4.0 |

[Preparation-1 of concentrated bleaching replenisher: sequential dissolution method (Comparative Example)]

In an open system of a work room at normal temperature and normal humidity, the components in the formulation above from the top to the maleic acid were sequentially added in the order described at an interval of 1 minute while stirring to a mixing tank containing 700 ml of soft water at 30° C., and the mixture was thoroughly stirred. From the time of adding ammonium 1,3-PDTA ferrate(III), precipitates were generated but the sequential addition was continued while stirring. Until the final, the whole amount could not be dissolved and a suspension in the slurry state, which was ready to sediment if left standing, was obtained. The pH was adjusted to 4.0 with aqueous ammonia, water was further added to make a total amount of 1 l, the pH was again adjusted to 4.0 and the mixture was stirred for 5 minutes to accomplish the composition. While keeping the suspended composition in the mixing tank in the visually homogeneous dispersion state by stirring, the composition was quickly transferred to four polyethylene terephthalate-made narrow-mouthed bottles each having an inner volume of 270 ml, in an amount of 250 ml per one bottle in the open system. A cap made of the same material was engaged with the bottle by a screw.

[Preparation-2 of concentrated bleaching replenisher: one-part powder mixing method (Invention)]

Out of the composition components, the constituent components except for ammonia, namely, solids components were previously mixed to form a one-part agent. To 700 ml of soft water at 30° C., 15 ml of aqueous ammonia (4N) was added, and into the resulting solution, the solid components mixed to form a one-part agent were charged at once while stirring. The mixture was further stirred for 5 minutes, the pH was adjusted to 4.0 with aqueous ammonia, water was added to make the total amount of 1 l to obtain a suspended liquid composition. The composition obtained was quickly transferred to four polyethylene terephthalate-made narrow-mouthed bottles each having an inner volume of 270 ml, which were the same in the constructive material and the shape as the bottles used in Comparative Example above, in an amount of 250 ml per one bottle. A cap made of the same material was engaged with the bottle by a screw.

[Evaluation results]

In the comparative sample by the sequential addition method, the precipitated components were solidified after aging of 1 day at room temperature and could not be completely re-dissolved even when diluting water was added thereto, and precipitates remained.

On the other hand, when the composition obtained by previously mixing solid constituent components to form a one-part agent and batchwise charging and mixing the components was aged for 10 days and then diluted with water, the components were completely dissolved and a bleaching replenisher free of suspension was obtained. This replenisher exhibited substantially the same results with respect to the bleaching rate, the density of image area and stains of non-image area, as those of a working solution newly prepared.

According to the production process of the present invention, at least two solid constituent components of the composition are previously mixed and then rapidly mixed with water or an aqueous solution containing a liquid constituent component under stirring, whereby a suspended concentrated liquid processing agent composition for silver halide photographic light-sensitive materials, having flowability for facilitating the handling and aging stability over a long period of time despite the concentrating to a degree of exceeding the component solubility, can be produced.

While the invention has been described in detail and with reference to specific embodiments thereof, it will be apparent to one skilled in the art that various changes and modifications can be made therein without departing from the spirit and scope thereof.

What is claimed is:

1. A process for producing a photographic suspended processing agent composition, comprising previously mixing at least two powder or granular solid components constituting said composition and rapidly adding said mixed powder or granular solids to water or a liquid medium mainly comprising water under quick stirring to disperse and suspend the solid components, thereby producing a suspended processing agent composition for silver halide photographic materials, wherein the composition further comprises a coagulation inhibitor selected from the group consisting of carboxymethyl cellulose, alkali metal salts thereof, compounds represented by formula (SI), and compounds represented by formula (SII):

$$RO(CH_2CH_2O)_m[CH_2CH(OH)CH_2O]_nX \quad \text{(SI)}$$

wherein R represents an alkyl group having from 8 to 25 carbon atoms or a group represented by the formula:

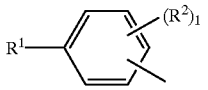

wherein $R^1$ represents an alkyl group having from 6 to 20 carbon atoms, $R^2$ represents a hydrogen atom or an alkyl group having from 1 to 20 carbon atoms, and 1 represents 0 or an integer of from 1 to 4, m represents an integer of from 40 to 200 when n is 0, an integer of from 10 to 100 when n is from 5 to 9, and 0 or an integer of from 1 to 100 when n is 10 or greater, n represents 0 or an integer of from 5 to 50, and X represents a hydrogen atom or $SO_3M$, wherein M represents a hydrogen atom or an alkali metal, $$R^3CON(CH)(CH)_pCOOM^2 \quad \text{(SII)}$$

$$\qquad\quad\;\; R^4 \quad R^5 \quad\;\; R^6$$

wherein $R^3$ represents an alkyl group, $R^4$ represents a hydrogen atom or an alkyl group, $R^5$ and $R^6$ each independently represents a hydrogen atom, a hydroxyl group, an alkyl group or $CO_2M^1$, $M^1$ and $M^2$ each represents a hydrogen atom or an alkali metal, and p represents 0 or 1.

2. The process for producing a photographic suspended processing agent composition as claimed in claim 1, wherein said coagulation inhibitor is a compound represented by formula (SI) or a compound represented by formula (SII).

3. The process for producing a photographic suspended processing agent composition as claimed in claim 2, wherein said mixed powder or granular solids are added in such a state that the water or the liquid medium in the mixing tank is being stirred by a turbulent flow having a Reynolds' number of 16 or more.

4. The process for producing a photographic suspended processing agent composition as claimed in claim 1, wherein said coagulation inhibitor is carboxymethyl cellulose having an etherification degree of 1.3 or more.

5. The process for producing a photographic suspended processing agent composition as claimed in claim 4, wherein said mixed powder or granular solids are added in such a state that the water or the liquid medium in the mixing tank is being stirred by a turbulent flow having a Reynolds' number of 16 or more.

6. The process for producing a photographic suspended processing agent composition as claimed in claim 1, wherein said mixed powder or granular solids are added in such a state that the water or the liquid medium in the mixing tank is being stirred by a turbulent flow having a Reynolds' number of 16 or more.

* * * * *